US005729262A

United States Patent [19]

Akiyama et al.

[11] Patent Number: 5,729,262

[45] Date of Patent: Mar. 17, 1998

[54] INK JET HEAD INCLUDING PHASE TRANSITION MATERIAL ACTUATORS

[75] Inventors: Yoshikazu Akiyama, Yokohama; Tomoyuki Yamaguchi, Chiba; Kakuji Murakami, Kawasaki; Yasuo Miyoshi, Yokohama, all of Japan

[73] Assignee: Ricoh Company, Ltd., Tokyo, Japan

[21] Appl. No.: 298,035

[22] Filed: Aug. 30, 1994

[30] Foreign Application Priority Data

| | | | |
|---|---|---|---|
| Aug. 31, 1993 | [JP] | Japan | 5-238963 |
| Sep. 1, 1993 | [JP] | Japan | 5-217382 |
| Oct. 29, 1993 | [JP] | Japan | 5-271481 |
| Dec. 22, 1993 | [JP] | Japan | 5-346510 |

[51] Int. Cl.[6] ..... B41J 2/045

[52] U.S. Cl. ..... 347/70; 310/358; 347/71

[58] Field of Search ..... 347/72, 70, 71; 252/62.9 PZ; 29/25.35; 310/358, 365, 366

[56] References Cited

U.S. PATENT DOCUMENTS

| | | | |
|---|---|---|---|
| 4,380,018 | 4/1983 | Andoh et al. | 347/46 |
| 4,523,121 | 6/1985 | Takahashi et al. | 310/365 X |
| 5,177,504 | 1/1993 | Ishii et al. | 347/68 |
| 5,424,769 | 6/1995 | Sakai et al. | 347/70 |
| 5,471,232 | 11/1995 | Hosono et al. | 347/70 |
| 5,477,253 | 12/1995 | Hotomi et al. | 347/71 |

FOREIGN PATENT DOCUMENTS

| | | | |
|---|---|---|---|
| 516188A1 | 2/1992 | European Pat. Off. | 347/72 |
| 62-141790 | 6/1987 | Japan | 310/366 |
| 3-190291 | 8/1991 | Japan | 310/366 |

*Primary Examiner*—Benjamin R. Fuller
*Assistant Examiner*—Charlene Dickens
*Attorney, Agent, or Firm*—Cooper & Dunham LLP

[57] ABSTRACT

An ink jet printing head includes a nozzle plate including nozzles, a plurality of ink cavities each containing ink, a plurality of actuators each made of a phase transition material, an oscillating plate having a top surface with which the ink in each ink cavity is brought into contact, and having a bottom surface bonded to each actuator, the oscillating plate pressing the ink in each ink cavity in association with the actuators to discharge ink drops from the nozzles at a sheet of paper so that an image is printed on the paper. In this ink jet printing head, the ink in each ink cavity is pressed by the oscillating plate in accordance with volumetric changes of the actuators, the volumetric changes being developed by applying an electric field to each actuator at a given electric field intensity, the given electric field intensity causing a transition of the phase transition material from an antiferroelectric phase into a ferroelectric phase to take place or causing a transition of the phase transition material from the ferroelectric phase into the antiferroelectric phase to take place.

20 Claims, 20 Drawing Sheets

INK JET HEAD INCLUDING PHASE TRANSITION MATERIAL ACTUATORS

BACKGROUND OF THE INVENTION

The present invention generally relates to an ink jet printing head, and more particularly to an ink jet printing head which has a plurality of actuators using a phase transition material having an improved piezoelectric characteristic to discharge ink.

A conventional ink jet printing head for use in an ink jet printer uses a piezoelectric actuator made of a piezoelectric material in order to discharge ink at a sheet of paper in accordance with an image signal. This ink jet printing head is composed of: a nozzle plate having a nozzle; an ink cavity containing ink; and an oscillating plate arranged on the piezoelectric actuator. The ink jet printing head discharges ink from the nozzle at a sheet of paper by using the piezoelectric actuator so that an image is printed on the paper. When an electric field is applied, a strain in the piezoelectric material is developed. It is used to realize the printing of the ink jet printing head. Hereinafter, this phenomenon is called the piezoelectric effect.

FIG. 1 shows a conventional multi-nozzle ink jet printing head of the type described above. In FIG. 1, the ink jet printing head includes a base 1, a set of piezoelectric actuators 2, an oscillating plate 3, an ink passage plate 4, a set of ink cavities 5, and a nozzle plate 6 having a set of nozzles 7. By using this printing head, a plurality of ink drops 8 are sprayed from the nozzles 7 at a sheet of paper so that an image is printed in accordance with a print data signal. The piezoelectric actuators 2 are arranged within the ink jet printing head so that changes in the piezoelectric actuators 2 in directions "d31" perpendicular to the electric field direction are developed by applying the electric field in accordance with the print data signal. The electric field is applied to the piezoelectric actuators 2 in accordance with the print data signal, and the changes in the piezoelectric actuators 2 are transferred to the ink within the ink cavities 5 via the oscillating plate 3 so that the ink drops 8 are sprayed from the nozzles 7.

FIGS. 2A and 2B show a strain in a piezoelectric material developed by applying a voltage to the piezoelectric material. A direction of polarization within the piezoelectric material is indicated by an arrow in FIG. 2A. A strained state of the piezoelectric material after the voltage is applied is indicated by a solid line in FIG. 2B, and an original state of the piezoelectric material before the voltage is applied is indicated by a two-dot chain line in FIG. 2B.

It is known that there are two piezoelectric effects relating to piezoelectric materials: one is a longitudinal induction piezoelectric effect, that is, dimensional changes in the material in directions "d33" parallel to the electric field direction are developed when the electric field is applied; and the other is a transversal induction piezoelectric effect, that is, dimensional changes in the material in directions "d31" perpendicular to the electric field direction are developed when the electric field is applied. The magnitude of changes in the material being developed depends on a piezoelectric coefficient of the individual materials. Typically, the rate of change of length in the parallel direction d33 relating to piezoelectric materials is approximately 0.09%, and the rate of change of length in the perpendicular direction d31 relating to piezoelectric materials is approximately −0.03%.

The ink jet printing head which uses the piezoelectric actuators mentioned above has already been put into practical use. However, a need for recent ink jet printers is to further increase the printing speed of the ink jet printers with a smaller size. To further increase the printing speed of an ink jet printer, it is necessary to improve the efficiency of ink discharging by each printing head of the ink jet printer. However, in a case of the conventional ink jet printing head, the efficiency of ink discharging is limited due to the use of the piezoelectric actuators. That is, according to the piezoelectric characteristics of the conventional actuators, the rate of change of length in a direction parallel to the longitudinal direction is about −0.03%, and the rate of change of length in a direction perpendicular to the longitudinal direction is about 0.09%.

In order to realize an increased ink discharging rate of an ink jet printing head for a recent ink jet printer having a high ink jet printing speed, it is desirable to provide the ink jet printing head with actuators having an improved piezoelectric characteristic. However, in a case of the conventional ink jet printing head using the piezoelectric actuators, it is necessary to make the size of the piezoelectric actuator greater in order to obtain a greater ink discharging quantity and a higher ink discharging speed. Therefore, it is difficult to obtain a higher ink discharging speed with a smaller size of an ink jet printing head in conformity with the needs of the recent ink jet printer by using the piezoelectric actuators. In addition, it is difficult to obtain a smaller size of an ink jet printing head in conformity with the needs of the recent ink jet printer by using the piezoelectric actuators.

SUMMARY OF THE INVENTION

Accordingly, it is a general object of the present invention to provide an improved ink jet printing head in which the above mentioned problem is eliminated.

Another, more specific object of the present invention is to provide an ink jet printing head which has an ink discharging speed higher than a conventional ink jet printing head using a piezoelectric material and has an ink discharging quantity greater than the conventional ink jet printing head by making use of actuators made of a phase transition material, so as to realize an increased printing speed of an ink jet printer with a smaller size.

Still another object of the present invention is to provide an ink jet printing head which has a size smaller than the size of a conventional ink jet printing head with no decrease of an ink discharging efficiency from a level of the conventional ink jet printing head by making use of actuators made of a phase transition material, so as to make the density of nozzles in the ink jet printing head higher.

A further object of the present invention is to provide an ink jet printing head which includes actuating elements made of a phase transition material which are covered with an insulating material and arranged within each of ink cavities so that changes of the phase transition material are transferred directly to the ink within each of the ink cavities, so as to realize an increased ink discharging rate with a smaller size.

The above mentioned object of the present invention is achieved by an ink jet printing head which includes a nozzle plate including nozzles, a plurality of ink cavities each of which contains ink, a plurality of actuators each of which is made of a phase transition material, an oscillating plate having a top surface with which the ink in each of the ink cavities is brought into contact, and having a bottom surface bonded to each of the actuators, the oscillating plate pressing the ink within each of the ink cavities in association with the actuators to discharge ink drops from the nozzles at a sheet of paper so that an image is printed on the paper. In the ink jet printing head mentioned above, the ink in each of the ink cavities is pressed by the oscillating plate in accordance with volumetric changes of each of the actuators developed by applying an electric field to the actuators at a given electric field intensity, the volumetric changes of each of the actuators being developed when a transition of the phase transition material from an antiferroelectric phase into a ferroelectric phase takes place or when a transition of the phase transition material from the ferroelectric phase into the antiferroelectric phase takes place.

The above mentioned object of the present invention is achieved by an ink jet printing head which includes a nozzle plate including nozzles, a plurality of ink cavities each of which contains ink, a plurality of pressure fluid chambers each of which contains pressure fluid, a plurality of actuators each of which is made of a phase transition material, an oscillating plate having a top surface with which the ink in each of the ink cavities is brought into contact, and having a bottom surface with which the pressure fluid in each of the pressure fluid chambers is brought into contact, the oscillating plate pressing the ink within each of the ink cavities in association with the actuators to discharge ink drops from the nozzles at a sheet of paper so that an image is printed on the paper. In this ink jet printing head, the actuators are respectively arranged within each of the pressure fluid chambers and the ink in each of the ink cavities is pressed by the oscillating plate in accordance with volumetric changes of each of the actuators developed by applying an electric field to the actuators at a given electric field intensity, the volumetric changes of each of the actuators being developed when a transition of the phase transition material from an antiferroelectric phase into a ferroelectric phase takes place or when a transition of the phase transition material from the ferroelectric phase into the antiferroelectric phase takes place, and the volumetric changes of each of the actuators being transferred to the oscillating plate through the pressure fluid in each of the pressure fluid chambers.

The above mentioned object of the present invention is achieved by an ink jet printing head which includes a nozzle plate including nozzles, a plurality of ink cavities each of which contains ink, and a plurality of actuating elements respectively provided within each of the ink cavities, each of the actuating elements being made of a phase transition material and comprising electrode layers and an insulating material for insulating at least the electrode layers from the ink in each of the ink cavities. In this ink jet printing head, the ink in each of the ink cavities is pressed by the actuating elements in accordance with volumetric changes of the phase transition material so as to discharge ink drops from the nozzles at a sheet of paper, the volumetric changes being developed by applying an electric field to each actuating element at a given electric field intensity, the given electric field intensity causing a transition of the phase transition material from an antiferroelectric phase into a ferroelectric phase to take place or causing a transition of the phase transition material from the ferroelectric phase into the antiferroelectric phase to take place.

According to the present invention, it is possible to realize an ink jet printing head having a remarkably high efficiency of ink discharging in conformity with the needs of recent ink jet printers, by making use of a phase transition material. It is possible to realize a multi-nozzle ink jet printing head having a small size in conformity with the needs of recent ink jet printers, by making use of a phase transition material. Further, it is possible to realize a remarkably high ink discharging rate of an ink jet printing head with a smaller size by using the actuating elements of the phase transition material which are arranged within each of the ink cavities.

BRIEF DESCRIPTION OF THE DRAWINGS

The above and other objects, features and advantages of the present invention will be more apparent from the following detailed description when read in conjunction with the accompanying drawings in which.

DESCRIPTION OF THE PREFERRED EMBODIMENTS

A description will now be given of antiferroelectric-phase to ferroelectric-phase transition material which is used by the ink jet printing head according to the present invention.

Figure 18:
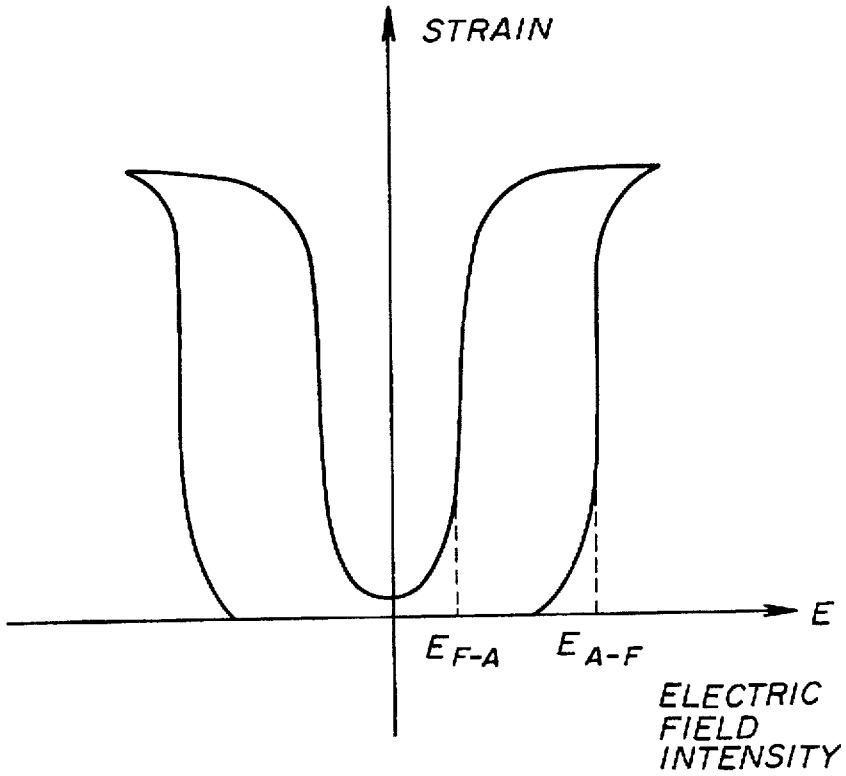
FIG. 18 is a diagram for explaining a strain in the phase transition material when the electric field intensity is varied.

FIG. 18 shows a strain in an antiferroelectric-phase to ferroelectric-phase transition material which is developed in accordance with an electric field intensity E. That is, the strain of the antiferroelectric-phase to ferroelectric-phase transition material which is developed when the intensity of the applied electric field is increased or decreased is shown in FIG. 18. In FIG. 18, changes in the polarization of the phase transition material developed when the electric field is applied are in accordance with changes in the strain in the phase transition material developed by applying the electric field. When the intensity of the applied electric field E is gradually increased from zero, a transition from the antiferroelectric phase into the ferroelectric phase takes place at a first transition intensity level $E_{A-F}$. At this point, the strain in the phase transition material is quickly increased by an extremely great amount as shown in FIG. 18. On the other hand, when the intensity of the applied electric field E is gradually decreased from the highest level, a transition from the ferroelectric phase into the antiferroelectric phase takes place at a second transition intensity level $E_{F-A}$. At this point, the strain in the phase transition material is quickly decreased in an extremely great amount. Therefore, it is possible to realize an increased ink discharging rate of an ink jet printing head by using the advantageous features of the phase transition material described above.

By applying an electric field to the antiferroelectric-phase to ferroelectric-phase transition material at the first transition intensity level $E_{A-F}$, the phase transition material develops a remarkably great change in the dimensions in an isotropic manner. This is different from piezoelectric materials (such as lead zirconate and lead titanate ceramics) since the piezoelectric materials change in dimensions in one direction only. Hereinafter, the antiferroelectric-phase to ferroelectric-phase transition material which is used by the actuator of the ink jet printing head according to the present invention will be referred to as the phase transition material.

Typically, the rate of change of volume (which rate is defined by ▲V/V) relating to the phase transition materials when a transition of the phase transition material from the antiferroelectric phase into the ferroelectric phase by applying the electric field thereto at the first transition intensity level is greater than the rate of change of the volume relating to the piezoelectric materials in the order of one or more digits. That is, the rate of change of the volume relating to the piezoelectric materials when the electric field is applied is typically about 0.03%, and the rate of change of the volume can be increased to about 1.10% if the phase transition materials are used instead. Therefore, a multi-nozzle ink jet printing head including actuators using the phase transition material described above can be built with a size smaller than the size of a conventional multi-nozzle ink jet printing head using the piezoelectric actuators, allowing a small size of the multi-nozzle ink jet printing head with a high ink discharging rate in conformity with the needs of recent ink jet printers.

As described above, the rate of change of length in the parallel direction d33 (parallel to the electric field direction) relating to the piezoelectric materials is about 0.09%, and the rate of change of length in the perpendicular direction d31 (perpendicular to the electric field direction) relating to the piezoelectric materials is about −0.03%. On the other hand, the rate of change of length in the parallel direction d33 relating to the phase transition materials is, typically, about 0.25%–0.80%, and the rate of change of length in the perpendicular direction d31 relating to the phase transition materials is, typically, about 0.075%–0.15%. Therefore, the volumetric changes of the phase transition materials developed by applying the electric field thereto at the first transition intensity level are much greater than the volumetric changes of the piezoelectric materials developed by applying the electric field.

Generally, the rate ▲V/V of change of volume relating to either the piezoelectric materials or the phase transition materials developed when the electric field is applied is defined by $$\blacktriangle V/V = X3 + 2 \cdot X1 \quad (1)$$

where X3 is the rate of change of length in the parallel direction and X1 is the rate of change of length in the perpendicular direction.

The ink jet printing head according to the present invention uses a laminate actuator which is made of the phase transition material. The typical phase transition materials which are used by the ink jet printing heads are: (1) a solid solution of composite ceramics including lead titanate, lead stannate and lead zirconate, and niobium partially substituting for the lead site thereof, and the composition of the phase transition material being defined by $PbNb[(ZrSn)Ti]O_3$; (2) a solid solution of composite ceramics including lead titanate, lead stannate and lead zirconate, and lanthanum partially substituting for the lead site thereof, and the composition of the phase transition material being defined by $PbLa[(ZrSn)Ti]O_3$; and (3) a solid solution of composite ceramics including lead titanate and lead zirconate, and lanthanum partially substituting for the lead site thereof, and the composition of the phase transition material being defined by $PbLa(ZrTi)O_3$.

The following are three preferred examples of the phase transition materials which are used by the ink jet printing head according to the present invention:

[EXAMPLE 1]

$$Pb_{1-0.5Z}Nb_Z[(Zr_{1-X}Sn_X)_{1-Y}Ti_Y]_{1-Z}O_3$$

$0 \leqq X \leqq 0.5$, $0 \leqq Y \leqq 0.1$, $0 \leqq Z \leqq 0.02$ where X, Y and Z are rational numbers. The composition of a preferred sample A of the phase transition material is defined by: $Pb_{0.99}Nb_{0.02}[(Zr_{0.5}Sn_{0.5})_{0.9}Ti_{0.1}]_{0.98}O_3$. In a case of the preferred sample A with the above composition, the rate of change of length in the parallel direction induced by applying the electric field is about 0.34%, and the rate of change of length in the perpendicular direction induced by applying the electric field is about 0.085%. The rate of change of volume relating to the above sample A is about 0.51%.

[EXAMPLE 2]

$Pb_{1-3/2Z}La_Z[(Zr_{1-X}Sn_X)_{1-Y}Ti_Y]O_3$ $0 \leqq X \leqq 0.5$, $0 \leqq Y \leqq 0.2$, $0 < Z \leqq 0.02$ where X, Y and Z are rational numbers. The composition of a preferred sample B of the phase transition material is defined by: $Pb_{0.97}La_{0.02}[(Zr_{0.74}Sn_{0.26})_{0.89}Ti_{0.11}]O_3$. In a case of the preferred sample B with the above composition, the rate of change of length in the parallel direction induced by applying the electric field is about 0.78%, and the rate of change of length in the perpendicular direction induced by applying the electric field is about 0.15%. The rate of change of volume relating to the above sample B is about 1.08%.

[EXAMPLE 3]

$Pb_{1-X}La_X(Zr_{1-Y}Ti_Y)_{1-X/4}O_3$ $0.08 \leqq X \leqq 0.24$, $0 \leqq Y \leqq 0.85$ where X and Y are rational numbers. The composition of a preferred sample C of the phase transition material is defined by: $Pb_{0.92}La_{0.08}(Zr_{0.7}Ti_{0.3})_{0.98}O_3$. In a case of the preferred sample C with the above composition, the rate of change of length in the parallel direction induced by applying the electric field is about 0.21%, and the rate of change of length in the perpendicular direction induced by applying the electric field is about 0.07%. The rate of change of volume relating to the above sample C is about 0.35%.

Two electric field induction effects, similar to the two piezoelectric effects relating to the piezoelectric materials, are used with the phase transition material according to the present invention: one is a longitudinal electric field induction effect, that is, volumetric changes in the phase transition material in the directions "d33" parallel to the electric field direction are developed by applying the electric field; and the other is a transversal electric field induction effect, that is, volumetric changes in the phase transition material in the directions "d31" perpendicular to the electric field direction are developed by applying the electric field.

Next, a description will be given, with reference to FIGS. 3 through 6, of an ink jet printing head in a first embodiment of the present invention.

Figure 1:
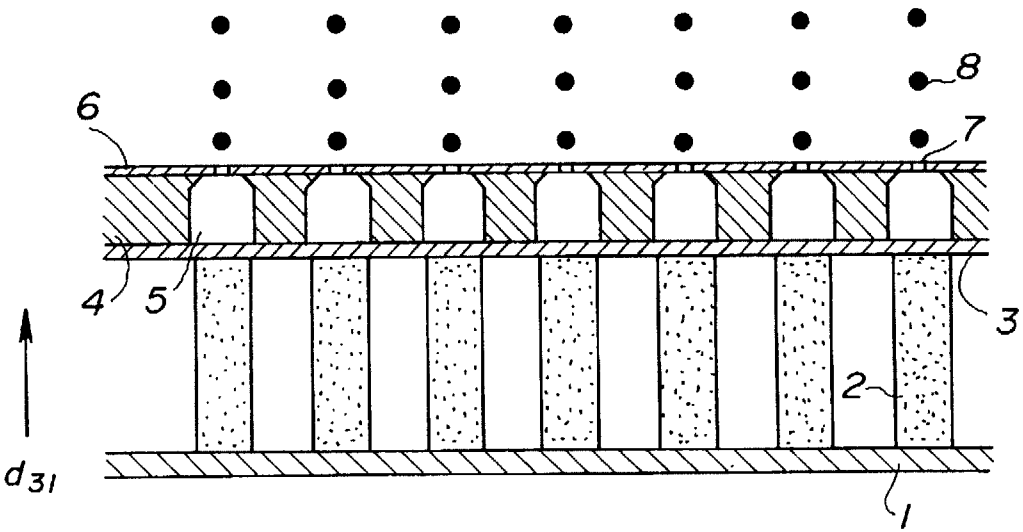
FIG. 1 PRIOR ART
FIG. 1 is diagram showing a conventional ink jet printing head.
Figure 2A:
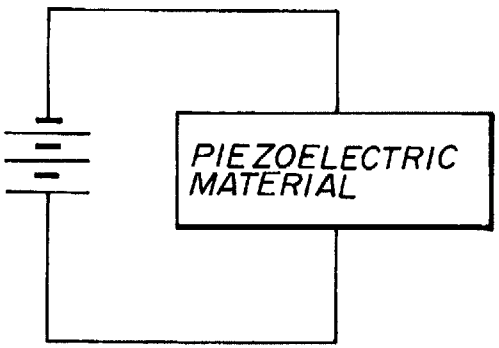
FIG. 2A PRIOR ART
FIGS. 2A and 2B are diagrams for explaining a strain in a piezoelectric material developed by applying an electric field to the piezoelectric material.
Figure 2B:
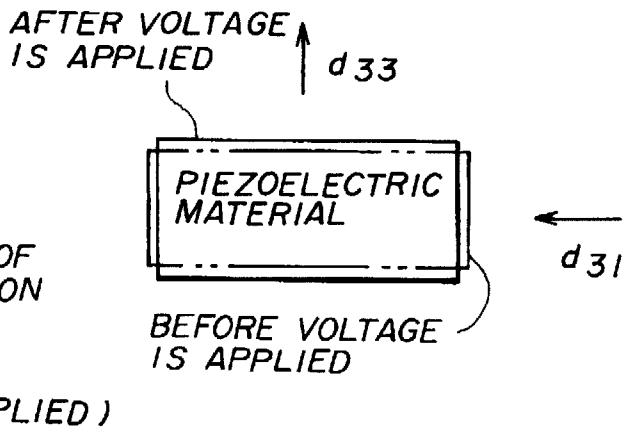
FIG. 2B PRIOR ART
Figure 3:
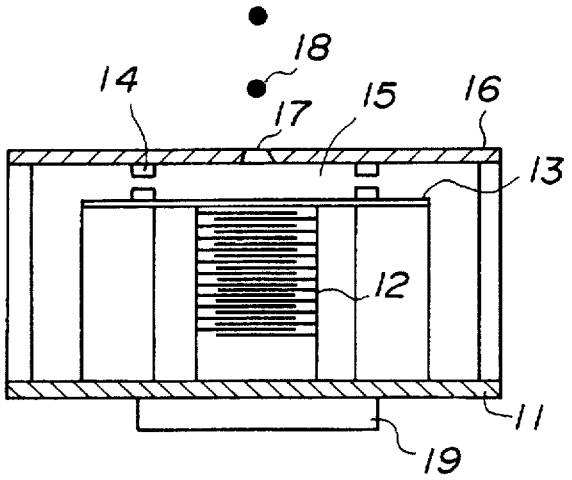
FIG. 3 is a sectional view showing an ink jet printing head in a first embodiment of the present invention, which uses a longitudinal strain developed when an electric field is applied.

FIG. 3 shows the ink jet printing head in the first embodiment. In FIG. 3, the ink jet printing head includes: a supporting base 11; a laminate actuator 12 made of a phase transition material; a nozzle plate 16 including nozzles 17; an ink cavity 15 containing ink; an oscillating plate 13 having a top surface with which the ink in the ink cavity 15 is brought into contact, and having a bottom surface bonded to the top of the actuator 12, the oscillating plate pressing the ink within the ink cavity in association with the actuator to discharge ink drops 18 from the nozzles 17 at a sheet of paper so that an image is printed on the paper. In FIG. 3, reference numeral 14 denotes a set of fluid resistances, and reference numeral 19 denotes a driver integrated circuit (IC) for controlling the ink jet printing head. The laminate actuator 12 made of the phase transition material develops a longitudinal strain when an electric field is applied to the laminate actuator 12 at the first transition intensity level. A portion of the phase transition material of the laminate actuator 12 which is supported on the supporting base 11 is made inactive to the electric field applied.

In the ink jet printing head described above, the ink in the ink cavity 15 is pressed by the oscillating plate 13 in accordance with volumetric changes of the actuator 12 developed by applying the electric field to the actuator 12 at the first transition intensity level. The volumetric changes of the actuator 12 are developed when a transition in the phase transition material from the antiferroelectric phase into the ferroelectric phase takes place.

Figure 4:
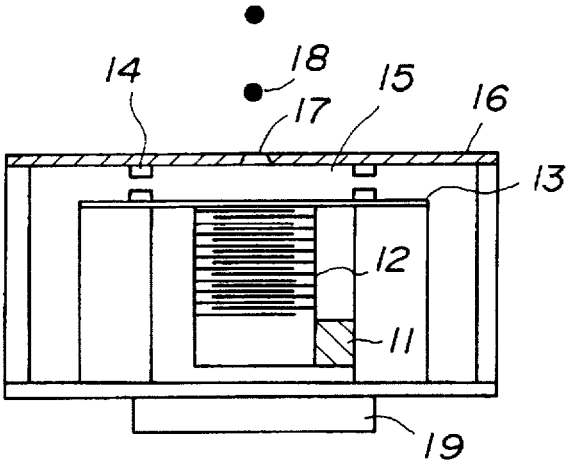
FIG. 4 is a sectional view showing a modification of the ink jet printing head in FIG. 3.

FIG. 4 shows a modification of the ink jet printing head in FIG. 3. In FIG. 4, the parts which are the same as corresponding parts in FIG. 3 are designated by the same reference numerals, and a description thereof will be omitted. In FIG. 4, the supporting base 11 is arranged sideways within the ink jet printing head in a manner different from the supporting base shown in FIG. 3. The laminate actuator 12 has a side surface which is supported on and fixed by the sideways supporting base 11. The laminate actuator 12 is made of the phase transition material according to the present invention and develops a longitudinal strain when an electric field is applied to the laminate actuator 12.

Figure 5:
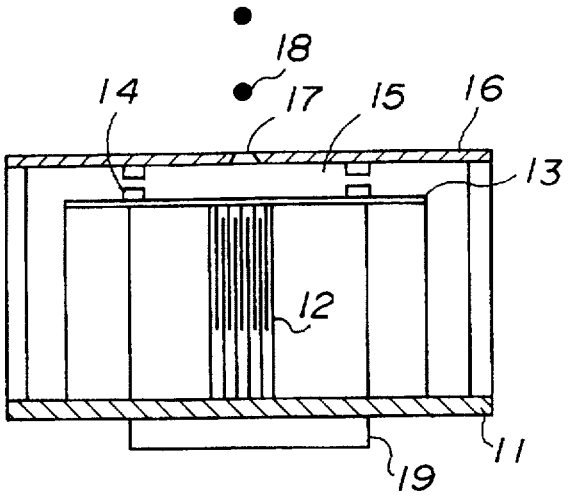
FIGS. 5 and 6 are sectional views showing modifications of the ink jet printing head in FIG. 3, which use a transversal strain developed when an electric field is applied.
Figure 6:
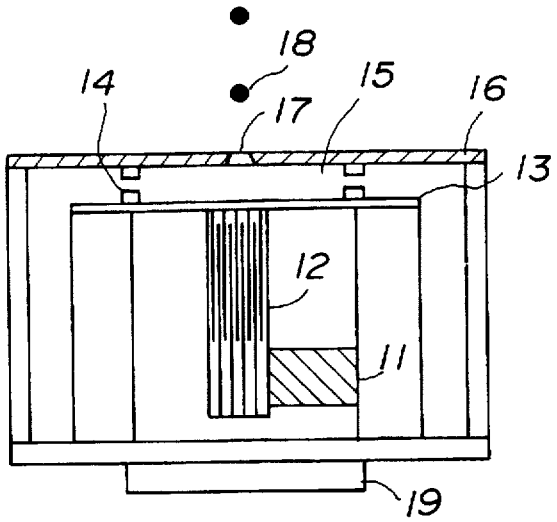

FIGS. 5 and 6 show other modifications of the ink jet printing head shown in FIG. 3. In FIGS. 5 and 6, the parts which are the same as corresponding parts in FIGS. 3 and 4 are designated by the same reference numerals, and a description thereof will be omitted. Similarly to the first embodiment in FIG. 3, the ink jet printing head in FIG. 5 includes a supporting base 11, a laminate actuator 12, an oscillating plate 13, a set of fluid resistances 14, an ink cavity 15, a nozzle plate 16, a nozzle 17 formed in the nozzle plate 16, and a driver integrated circuit (IC) 19. The laminate actuator 12 is made of the phase transition material according to the present invention and develops a transversal strain when an electric field is applied to the laminate actuator 12.

In FIG. 6, the supporting base 11 is arranged sideways within the ink jet printing head in a manner different from the supporting base shown in FIG. 5. The laminate actuator 12 includes a side surface supported on and fixed by the sideways supporting base 11. The laminate actuator 12 is made of the phase transition material according to the present invention and develops a transversal strain when an electric field is applied to the laminate actuator 12.

The ink jet printing head as shown in each of FIGS. 3 through 6 includes the laminate actuator 12 of the phase transition material, the nozzle 17, the ink cavity 15 containing ink, and the oscillating plate 13 bonded to the laminate actuator 12 and coming in contact with the ink within the ink cavity 15. The laminate actuator 12 is driven by applying a drive voltage thereto in accordance with a print data signal. As an electric field is thus applied to the phase transition material, a strain in the phase transition material is developed and the oscillating plate 13 deflects due to the strain in the phase transition material, so that the ink within the ink cavity 15 is pressed by the oscillating plate 13 to discharge an ink drop 18 from the nozzle 17.

The nozzle 17 is formed by using one of several forming methods which is suitable for the ink jet printing head. One suitable method of forming the nozzle 17 is that a plurality of nozzles 17 are formed within a nozzle plate 16 and the nozzle plate 16 is bonded to a member which forms the ink cavity 15. Another method is that a nozzle 17 is formed as a part of the ink cavity 15 and a member which forms the ink cavity 15 is formed integrally with a nozzle plate 16.

The oscillating plate 13 serves as a separating wall which separates the ink cavity 15 from the laminate actuator 12.

The oscillating plate 13 is made of plastic material or metal material. When it is required, the oscillating plate 13 is coated with a protective layer, and the protective layer may be produced by surface treatment and it may be a thin film coating. It is unnecessary that the oscillating plate 13 is in the sheet-like form having a uniform thickness. The oscillating plate 13 may be shaped in a suitable form that can efficiently transfers a displacement of the phase transition material to the ink within the ink cavity 15 via the oscillating plate so that an ink drop is discharged.

Figure 7A:
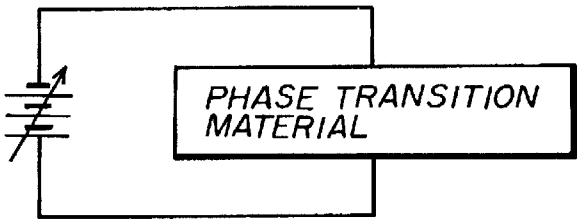
FIGS. 7A and 7B are diagrams for explaining a strain in a phase transition material developed by applying an electric field.
Figure 7B:
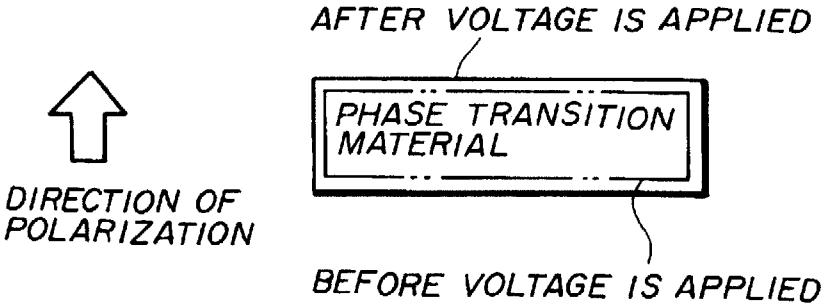

FIGS. 7A and 7B show a strain in the phase transition material developed by applying an electric field to the phase transition material at the first transition intensity level. A direction of polarization within the phase transition material is indicated by an arrow in FIG. 7A. A strained state of the phase transition material after the drive voltage is applied is indicated by a solid line in FIG. 7B, and the original state of the phase transition material before the drive voltage is applied is indicated by a two-dot chain line in FIG. 7B. By applying the drive voltage from a power supply to the phase transition material at the first transition as shown in FIG. 7A, a strain in the phase transition material is developed and the dimensional changes by applying the drive voltage thereto are isotropic as shown in FIG. 7B.

Generally, there are three kinds of phase transition which may take place within the phase transition materials: (1) antiferroelectric-phase to ferroelectric-phase transition; (2) paraelectric-phase to ferroelectric-phase transition; and (3) paraelectric-phase to antiferroelectric-phase transition. The strain in the phase transition material obtained by using the antiferroelectric-phase to ferroelectric-phase transition of the first kind mentioned above is greater than the strain in the phase transition material obtained by using the second and third kinds of the phase transition mentioned above. In order to make the ink discharging rate of the ink jet printing head as high as possible, the actuator of the ink jet printing head according to the present invention uses the first kind of the phase transition mentioned above.

The laminate actuator 12 of the ink jet printing head is composed of a set of thin phase transition material layers and a set of electrode layers which are alternately laminated to each other. A voltage required to drive the ink jet printing head using the laminate actuator 12 can be made lower than a voltage required to drive an ink jet printing head using a single-layer actuator. Thus, the ink jet printing head using the laminate actuator 12 according to the present invention can be driven with a relatively low level of the drive voltage applied to the phase transition material.

The thin phase transition material layers of the laminate actuator 12 of the ink jet printing head may be arranged either in a direction parallel to the oscillating plate 13 or in a direction perpendicular to the oscillating plate 13. When the thin phase transition material layers of the laminate actuator 12 are arranged in the perpendicular direction, one or a plurality of the thin phase transition material layers extending in parallel to the oscillating plate 13 are laminated to each other.

Figure 8:
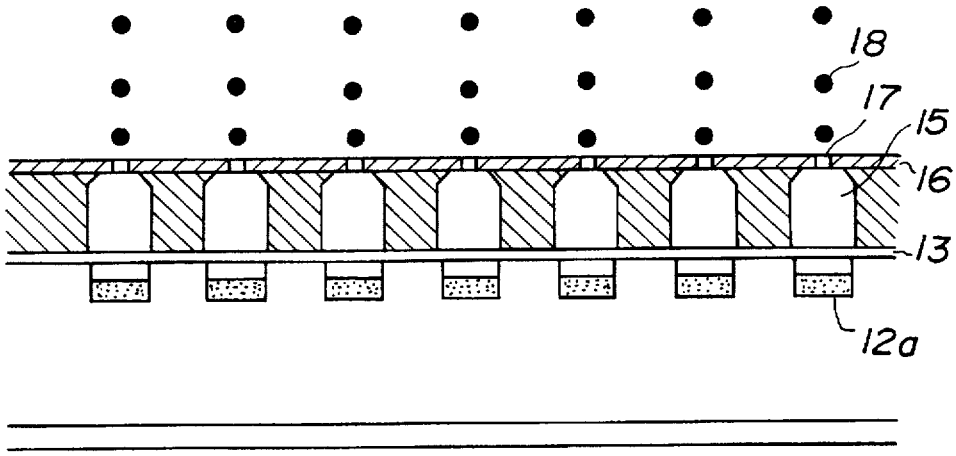
FIG. 8 is a diagram showing a multi-nozzle ink jet printing head in a second embodiment of the present invention.
Figure 9:
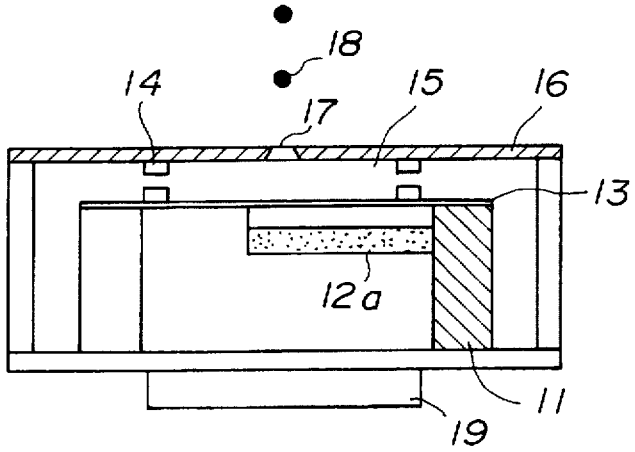
FIG. 9 is a sectional view showing an actuator of the ink jet printing head in FIG. 8.

FIG. 8 shows a multi-nozzle ink jet printing head in a second embodiment of the present invention. In FIG. 8, the ink jet printing head includes a set of actuators 12*a* of the phase transition material, an oscillating plate 13 in a sheet-like form, a set of ink cavities 15, and a nozzle plate 16 having a set of nozzles 17. By using this printing head, a plurality of ink drops 18 are discharged from the nozzles 17 at a sheet of paper so that an image is printed in accordance with a print data signal. FIG. 9 shows one of the actuators 12*a* used in the ink jet printing head in FIG. 8. In FIGS. 8 and 9, the parts which are the same as corresponding parts shown in FIGS. 3 through 6 are designated by the same reference numerals, and a description thereof will be omitted.

In FIG. 9, the supporting base 11 is arranged sideways within the ink jet printing head, and the actuator 12*a* has an end surface which is supported on the sideways supporting base 11. The actuator 12*a* is made of the phase transition material according to the present invention and develops a longitudinal strain or a transversal strain when an electric field is applied.

Figure 10A:
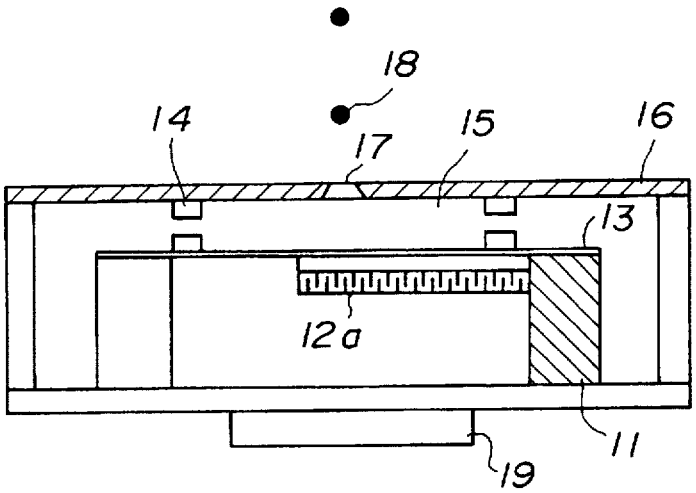
FIGS. 10A and 10B are sectional views showing modifications of the actuator used in the ink jet printing head in FIG. 8.
Figure 10B:
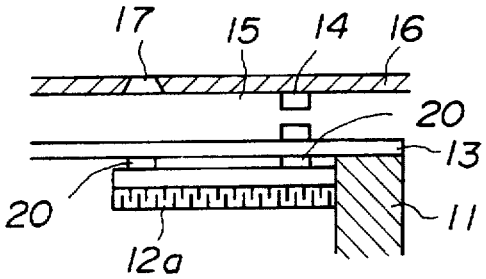

FIGS. 10A and 10B show modifications of the actuator used in the ink jet printing head in FIG. 8. In FIGS. 10A and 10B, the parts which are the same as corresponding parts shown in FIG. 9 are designated by the same reference numerals, and a description thereof will be omitted.

In FIG. 10A, a plurality of thin phase transition material layers of the actuator 12*a* are arranged in a direction parallel to the oscillating plate 13, and the layers vertically extending are horizontally laminated with each other. The actuator 12*a* uses a longitudinal strain within the phase transition material layers developed when an electric field is applied.

In FIG. 10B, the ink jet printing head using the actuator 12*a* includes a set of spacers 20, and the spacers 20 are arranged between the oscillating plate 13 and the actuator 12*a*. The actuator 12*a* in FIG. 10B uses a longitudinal strain developed when an electric field is applied. By using the spacers 20, it is possible that the oscillating plate 13 is subjected to a greater amount of a longitudinal strain within the actuator 12*a* induced by applying an electric field to the actuator 12*a* of the phase transition material.

Figure 11:
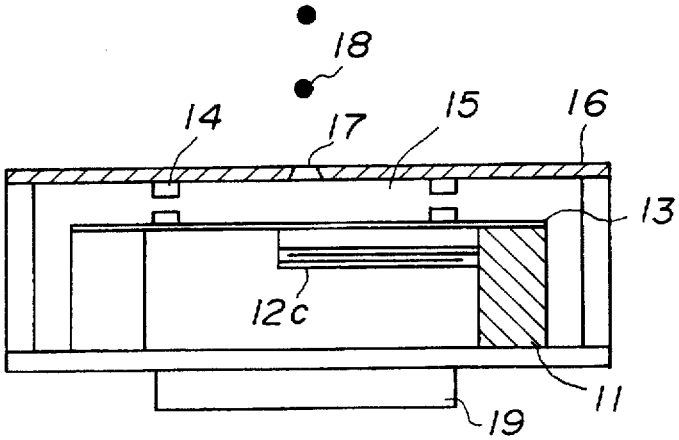
FIG. 11 is a sectional view showing another actuator of the ink jet printing head according to the present invention.

FIG. 11 shows another actuator of the ink jet printing head according to the present invention, which is different from the actuators shown in FIGS. 9 through 10B. In FIG. 11, the parts which are the same as corresponding parts shown in FIGS. 9 through 10B are designated by the same reference numerals, and a description thereof will be omitted.

In FIG. 11, the supporting base 11 is arranged sideways within the ink jet printing head, and the actuator 12*c* has an end surface which is supported on the sideways supporting base 11. The actuator 12*c* of the phase transition material uses a transversal strain developed when an electric field is applied. A plurality of thin phase transition material layers of the actuator 12*c* are arranged in a direction perpendicular to the oscillating plate 13. The phase transition material layers of the actuator 12*c* extend in a direction parallel to the oscillating plate 13 and they are vertically laminated to each other.

Figure 12A:
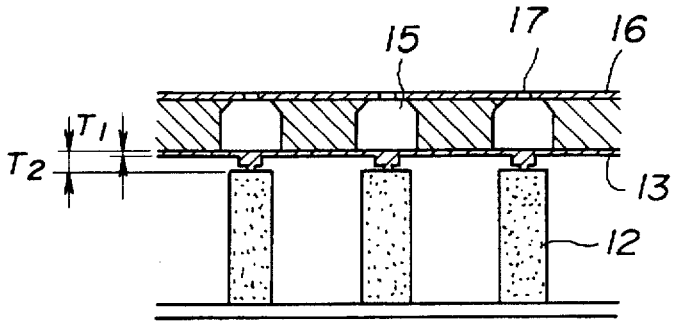
FIGS. 12A through 12C are sectional views showing a modification of an oscillating plate used in the ink jet printing head according to the present invention.
Figure 12B:
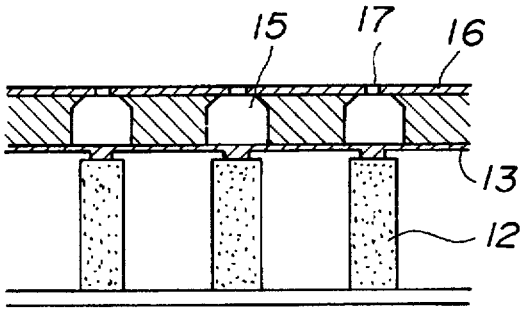
Figure 12C:
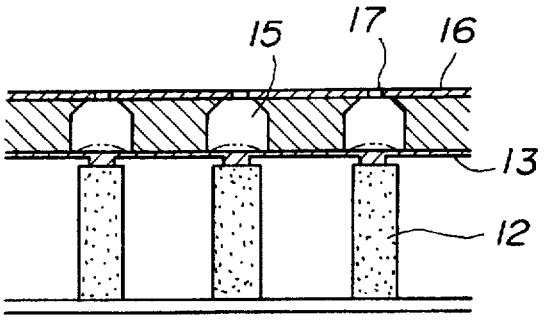

FIGS. 12A through 12C show a modification of the oscillating plate used in the ink jet printing head according to the present invention. In FIG. 12A, the parts which are the same as corresponding parts shown in FIG. 8 are designated by the same reference numerals, and a description thereof will be omitted.

As described above, the oscillating plate 13 of the ink jet printing head shown in FIG. 8 is made in a sheet-like form having a uniform thickness. In FIG. 12A, the ink jet printing head includes a modified oscillating plate 13. Thus, the ink jet printing head in FIG. 12A includes a set of actuators 12 of the phase transition material, the modified oscillating plate 13, a set of ink cavities 15, and a nozzle plate 16 having a set of nozzles 17. Each of the actuators 12 has a bottom surface supported on the supporting base. Portions of the oscillating plate 13 which are bonded to the top surfaces of the actuators 12 are made with an enlarged thickness "T2" as indicated in FIG. 12A, and the other portions of the oscillating plate 13 which are not bonded directly to the actuators 12 are left in the sheet-like form with a relatively small thickness "T1" as indicated in FIG. 12A. The thickness T1 is much smaller than the enlarged thickness T2 in order to increase the ink discharging efficiency of the ink jet printing head.

FIG. 12B shows a condition of the modified oscillating plate 13 when no electric field is applied to the actuators 12, and FIG. 12C shows a condition of the modified oscillating plate 13 when an electric field is applied to the actuators 12, and dimensional changes in the modified oscillating plate 13 due to the strains in the actuators 12 being induced are indicated by dotted lines in FIG. 12C. By using the modified oscillating plate 13 described above, it is possible to convey a relatively great amount of the dimensional changes in the oscillating plate 13 to the ink within the ink cavities 15, with a relatively low level of the drive voltage being applied to the actuators 12. Therefore, it is possible to suitably drive the ink jet printing head using the actuators 12 and the modified oscillating plate 13 with a relatively small quantity of electric power.

In the ink jet printing head described above, the ink within the ink cavities 15 is a liquid ink, and ink drops 18 are discharged from the nozzles 17 at a sheet of paper by using the volumetric changes of the phase transition material actuators 12 via the oscillating plate 13 bonded to the actuators 12, so that an image is printed on the paper in accordance with the print data signal. However, the present invention can be applied to a hot melt type ink jet printing head.

Next, a description will be given of the hot melt type ink jet printing head to which the present invention is applied, with reference to FIGS. 13A through 15. In the hot melt type ink jet printing head, there are provided an ink supplying part containing ink in a solid state, an ink passage for transferring the ink from the ink supplying part to ink cavities, and a heating element arranged inside the ink cavities or arranged outside the ink cavities and adjacent to the phase transition material actuators. The solid ink supplied from the ink supplying part to the ink cavities is heated by the heating elements so that the ink turns into a liquid ink at an increased temperature. The liquid ink is within the ink cavities of the hot melt type ink jet printing head, and ink drops 18 are discharged from the nozzles 17 at a sheet of paper by using the phase transition material actuators 12, so that an image can be printed on the paper.

The ink discharging efficiencies of the ink jet printing head using the liquid ink and the ink jet printing head using the hot melt type ink are substantially the same as each other.

In addition, as described above, changes in the phase transition material are developed in an isotropic manner when an electric field is applied. The rate of change of volume relating to the phase transition material is remarkably high when compared with the rate of change of volume relating to the piezoelectric material. In a case of an ink jet printing head wherein the phase transition material actuators are arranged within the ink cavities, it is possible to realize a remarkably increased piezoelectric effect by using the strains in the phase transition material actuators induced by applying the electric field. As the electric conductivity of the hot melt ink is lower than the electric conductivity of the liquid ink, it is possible to suitably apply the electric field to the phase transition material actuators arranged within the ink cavities.

Figure 13A:
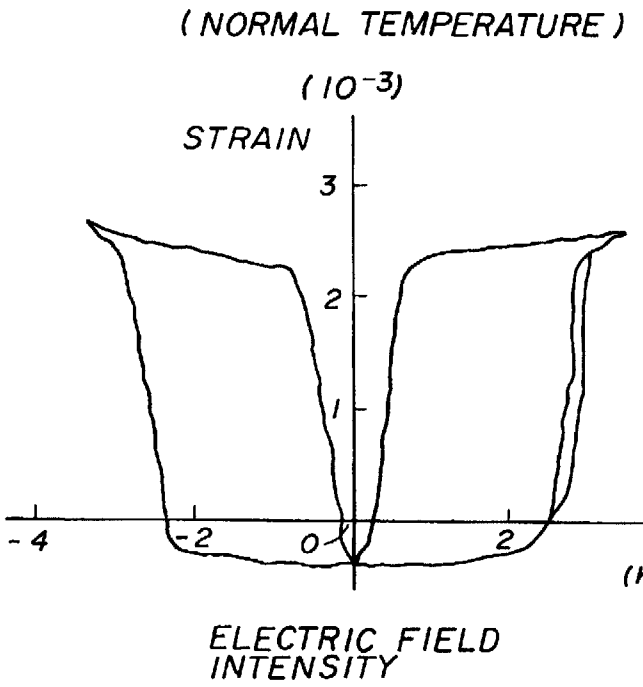
FIGS. 13A and 13B are diagrams for explaining strains in the phase transition material developed at normal and high temperatures when the electric field intensity varies.
Figure 13B:
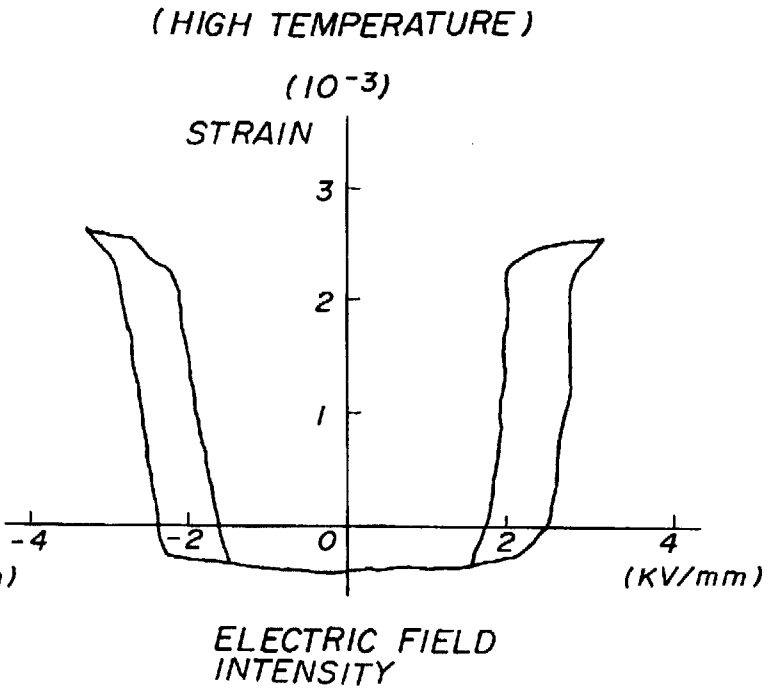

FIGS. 13A and 13B show strains in the phase transition material developed at normal and high temperatures when the intensity of the applied electric field varies. In FIG. 13A, a strain characteristic of the phase transition material at normal temperature when the electric field intensity is increased or decreased is shown. In FIG. 13B, a strain characteristic of the phase transition material at high temperature (50° to 100° C.) when the electric field intensity is increased or decreased is shown. As shown, values of the electric field intensity when the transition from the ferroelectric phase back to the antiferroelectric phase takes place in the normal temperature case in FIG. 13A are shifted to higher intensity values in the high temperature case in FIG. 13B. This feature of the phase transition material is appropriate for a hot melt type ink jet printing head since the phase transition material actuators are driven with a pulsed voltage signal superimposed on an offset voltage signal in the hot met type ink jet printing head. When the ink jet printing head is driven at the high temperature, the load on a drive circuit used to drive the hot melt type ink jet printing head can be reduced.

Figure 14:
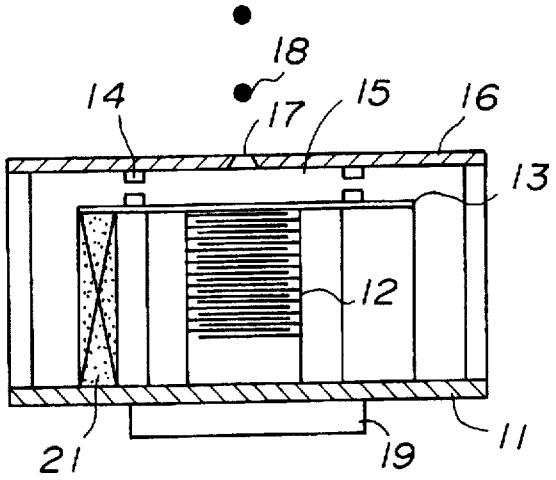
FIG. 14 is a sectional view showing a hot melt type ink jet printing head in a third embodiment of the present invention.

FIG. 14 shows a hot melt type ink jet printing head in a third embodiment of the present invention. In FIG. 14, the ink jet printing head includes a heating element 21 arranged outside the ink cavity 15 and adjacent to an ink supplying part (not shown). The solid-state ink in the ink supplying part is heated by the heating element 21 to a prescribed increased temperature so that the ink supplied to the ink cavity 15 turns into a liquid-state ink. The liquid-state ink is supplied to the ink cavity 15 of the hot melt type ink jet printing head, and ink drops 18 are discharged from the nozzle 17 at a sheet of paper by using the phase transition material actuator 12, so that an image is printed on the paper.

Figure 15:
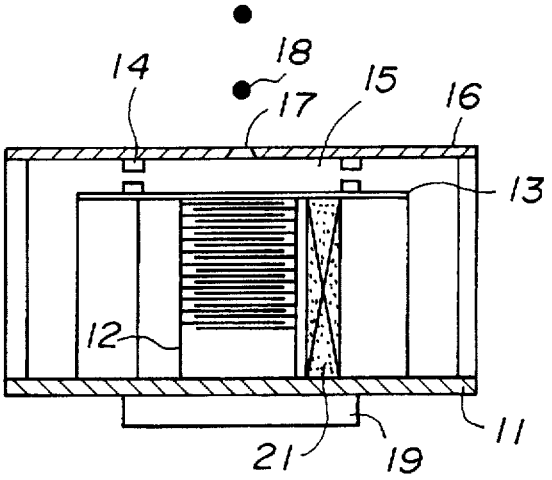
FIG. 15 is a sectional view showing a modification of the ink jet printing head in FIG. 14.

FIG. 15 shows a modification of the ink jet printing head of the type shown in FIG. 14. In FIG. 15, the ink jet printing head includes a plurality of heating elements 21 arranged outside the ink cavity 15 and adjacent to each of the phase transition material actuators 12. In this printing head, the phase transition material actuators 12 are heated by the heating elements 21 to a prescribed increased temperature, and the electric field induction strain characteristic of the phase transition material in the high temperature case as shown in FIG. 13B can be obtained by the heating. As described above, in the ink jet printing head, the phase transition material actuators can be readily driven with a pulsed voltage signal superimposed on an offset voltage signal.

Figure 16:
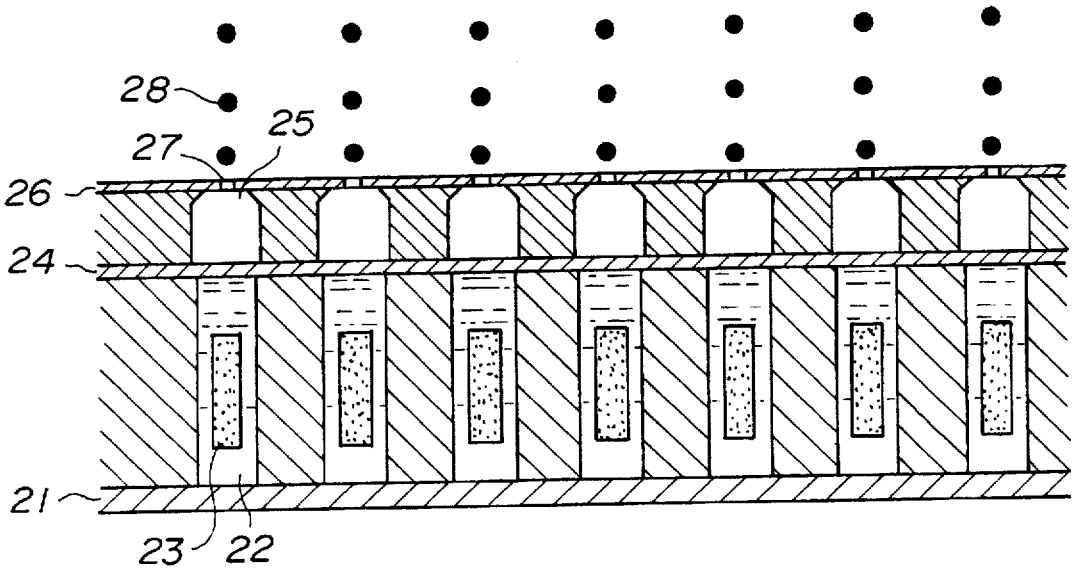
FIG. 16 is a diagram showing a multi-nozzle ink jet printing head in a fourth embodiment of the present invention.

Next, a description will be given of a multi-nozzle ink jet printing head in a fourth embodiment of the present invention. FIG. 16 shows the multi-nozzle ink jet printing head in the fourth embodiment. In FIG. 16, the multi-nozzle ink jet printing head includes: a supporting base 21; a plurality of pressure fluid chambers 22 each of which contains pressure fluid; a plurality of actuators 23 of the phase transition material according to the present invention which are respectively arranged within each of the pressure fluid chambers 22; an oscillating plate 24 having a top surface with which the ink is brought into contact and having a bottom surface with which the pressure fluid in each of the pressure fluid chambers 22 is brought into contact; a plurality of ink cavities 25 each of which contains the ink; and a nozzle plate 26 having nozzles 27. The actuators 23 are made of the phase transition material according to the present invention and uses volumetric changes of the phase transition material developed when the electric field is applied to the phase transition material at the first transition intensity level. By using this ink jet printing head, a plurality of ink drops 28 are discharged from the nozzles 27 at a sheet of paper so that an image is printed on the paper.

Figure 17:
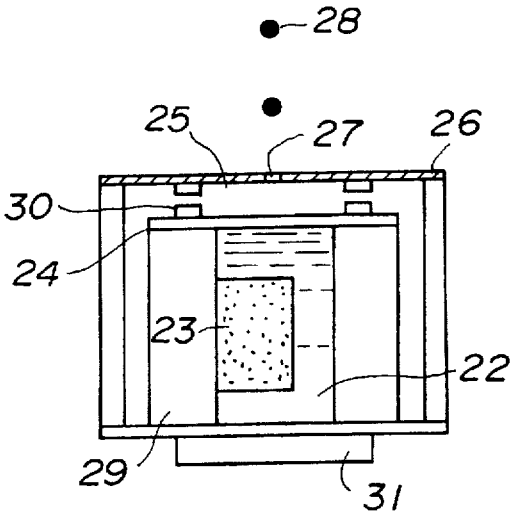
FIG. 17 is a sectional view showing one of the actuators of the ink jet printing head in FIG. 16.

FIG. 17 shows one of the actuators used in the ink jet printing head in FIG. 16. In FIG. 17, the actuator 23 of the phase transition material according to the present invention is arranged within the pressure fluid chamber 22, and the ink within the ink cavity 25 is pressed by the oscillating plate 24 in accordance with volumetric changes of the actuator 23 developed by applying the electric field to the actuator 23 at the first transition intensity level $E_{A-F}$. The volumetric changes of the actuator 23 mentioned above are developed when a transition in the phase transition material from the antiferroelectric phase into the ferroelectric phase takes place, and the volumetric changes are transferred to the oscillating plate 24 through the pressure fluid in the pressure fluid chamber 22.

In FIG. 17, reference numeral 29 denotes a supporting member on which the actuator 23 is supported sideways, reference numeral 30 denotes a set of fluid resistances, and reference numeral 31 denotes a driver IC which drives the ink jet printing head.

The oscillating plate 24 serves as a separating wall which separates the ink cavity 25 from the pressure fluid chamber 22. The oscillating plate 24 is made of plastic material or metal material. When it is required, the oscillating plate 24 is coated with a protective layer, and the protective layer may be produced by surface treatment and it may be a thin film coating. It is unnecessary that the oscillating plate 24 is in the sheet-like form having a uniform thickness. The oscillating plate 24 may be shaped in a suitable form that can efficiently transfers the volumetric changes of the phase transition material to the ink within the ink cavity 25 via the pressure fluid so that ink drops 28 are discharged from the nozzles 27.

It is desirable that the actuators 23 are arranged within each of the ink cavities 25 in order to efficiently transfer the volumetric changes of the phase transition material to the ink. However, when a conductive aqueous ink is used and the actuators 23 are placed into the aqueous ink within the ink cavities 25, it is impossible to suitably apply the electric field to the actuators 23 without depositing the ink color. In a case of the fourth embodiment described above, the above problem is eliminated even when the conductive aqueous ink is used. The actuators 23 are arranged within each of the pressure fluid chambers 22 and the ink within the ink cavities 25 is pressed by the oscillating plate 24 in accordance with the volumetric changes of the actuators 23 developed by applying the electric field to the actuators 23 at the first transition intensity level $E_{A-F}$. In the case of the fourth embodiment, it is possible to suitably apply the electric field to the actuators 23 within the pressure fluid chambers 22 which do not come into contact with the ink within the ink cavities 25.

It is necessary that the pressure fluid in each of the pressure fluid chambers 22 is highly resistant to electricity and has an isolating characteristic and has a low viscosity in a range of usable temperatures. The pressure fluid is, preferably, an insulating liquid having an electric resistivity equal to or greater than $10^5$ Ω·m. Also, the pressure fluid is flowable at temperatures of −20° C. to 150° C. and boils at a temperature equal to or higher than 100° C. Liquid that is evaporative at normal temperatures is not suitable for the pressure fluid since the pressure transfer efficiency of the pressure fluid becomes excessively low if bubbles are likely to be produced. In order to increase the pressure transfer efficiency, it is necessary that the pressure fluid is sufficiently flowable in the range of usable temperatures. For example, oils such as silicon oil or resins having a low viscosity are suitable for the pressure fluid in each of the pressure fluid chambers 22.

Figure 19:
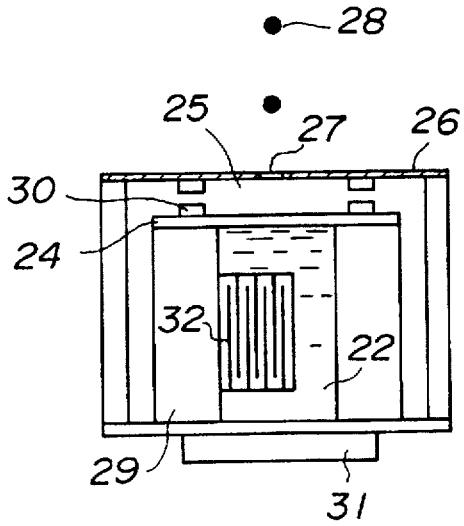
FIG. 19 is a sectional view showing a modification of the actuator of the ink jet printing head in FIG. 17.

FIG. 19 shows a modification of the actuator of the ink jet printing head in FIG. 17. In FIG. 19, the ink jet printing head includes a laminate actuator 32 instead of the actuator 23. In the laminate actuator 32, a plurality of thin phase transition material layers are laminated to each other in a direction in parallel to the oscillating plate 24. The other parts of the ink jet printing head in FIG. 19 are the same as corresponding part of the ink jet printing head in FIG. 17.

Figure 20:
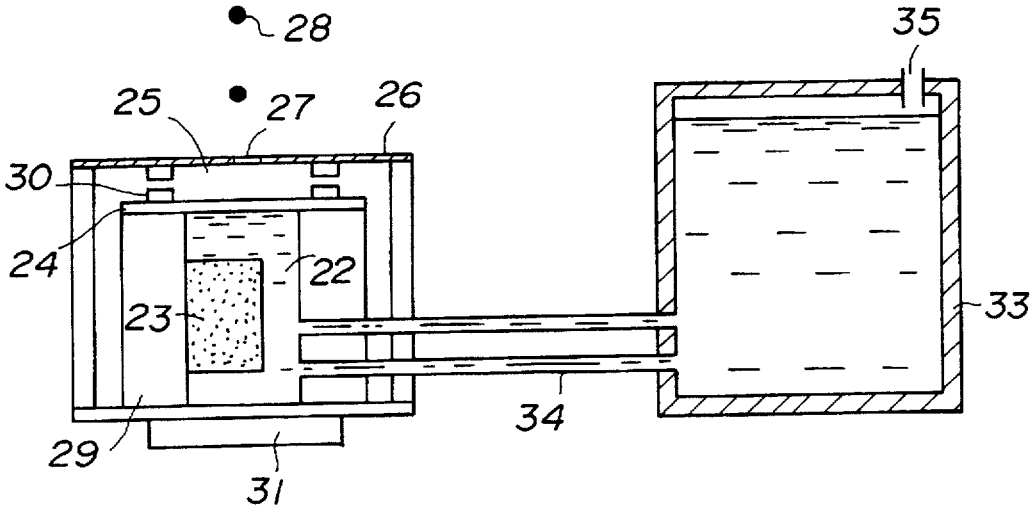
FIG. 20 is a sectional view showing another modification of the ink jet printing head in FIG. 17.

FIG. 20 shows another modification of the ink jet printing head in FIG. 17. In FIG. 20, the ink jet printing head further includes a common fluid chamber 33 which communicates with each of the pressure fluid chambers 22 via pipes 34. The common fluid chamber 33 has an opening 35 at which the inside of the common fluid chamber 33 opens to the atmosphere. When the pressure fluid in each of the pressure fluid chambers 22 expands or shrinks according to the temperature of the environment, it is possible that the pressure fluid chambers 22 are always filled with the pressure fluid, and that the pressure transfer efficiency of the pressure fluid is kept at an appropriate level. Thus, the ink jet printing head in FIG. 20 can realize an increased ink discharging rate with a stable printing operation.

Figure 21:
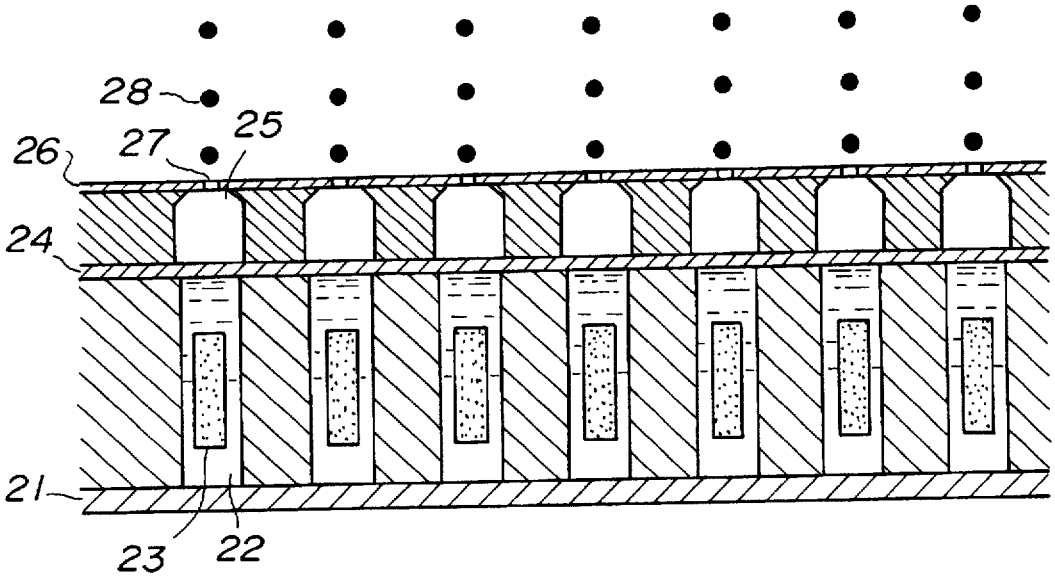
FIG. 21 is a diagram showing a hot melt type multi-nozzle ink jet printing head in a fifth embodiment of the present invention.
Figure 22:
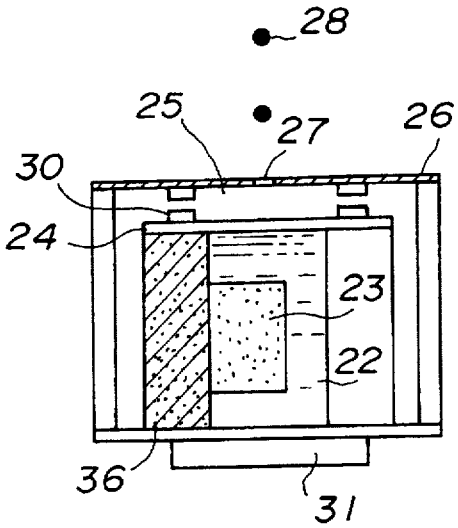
FIGS. 22 is sectional view showing the ink jet printing head in FIG. 21.

FIG. 21 shows a hot melt type ink jet printing head in a fifth embodiment of the present invention. FIG. 22 shows one of the actuators 23 of the ink jet printing head in FIG. 21. In FIG. 22, the ink jet printing head further includes a heating element 36 which is arranged adjacent to the ink cavity 25 and to the pressure fluid chamber 22. In the ink jet printing head in FIG. 22, the ink within each of the ink cavities is a liquid-state ink produced by heating a solid-state ink from an ink supplying part (not shown) by using the heating element 36. The other parts of the ink jet printing head in the fifth embodiment are essentially the same as corresponding parts of the ink jet printing head in FIGS. 16 and 17. Similarly to the fourth embodiment, the actuators 23 in the fifth embodiment are arranged within each of the pressure fluid chambers 22. It is possible to suitably carry out the ink jet printing regardless of whether the aqueous ink or the hot melt ink is used. The ink discharging efficiencies of the ink jet printing head using the aqueous ink and the ink jet printing head using the hot melt ink are substantially the same as each other.

Next, a description will be given of an ink jet printing head in a sixth embodiment of the present invention with reference to FIGS. 23A through 27.

In the preceding embodiments described above, the oscillating plate is arranged so that the ink in the ink cavities is pressed by the oscillating plate in accordance with volumetric changes of the phase transition material developed by applying the electric field, so as to discharge ink drops at a sheet of paper. However, in order to make more efficient use of the volumetric changes of the phase transition material, it is desirable to transfer the volumetric changes of the phase transition material directly to the ink within each of the ink cavities by arranging the actuating elements within each of the ink cavities with no oscillating plate provided. In the sixth embodiment, which will be described below, the actuating elements of the phase transition material are covered with an insulating material and arranged within each of the ink cavities, in order to make efficient use of the volumetric changes of the phase transition material.

Figure 23A:
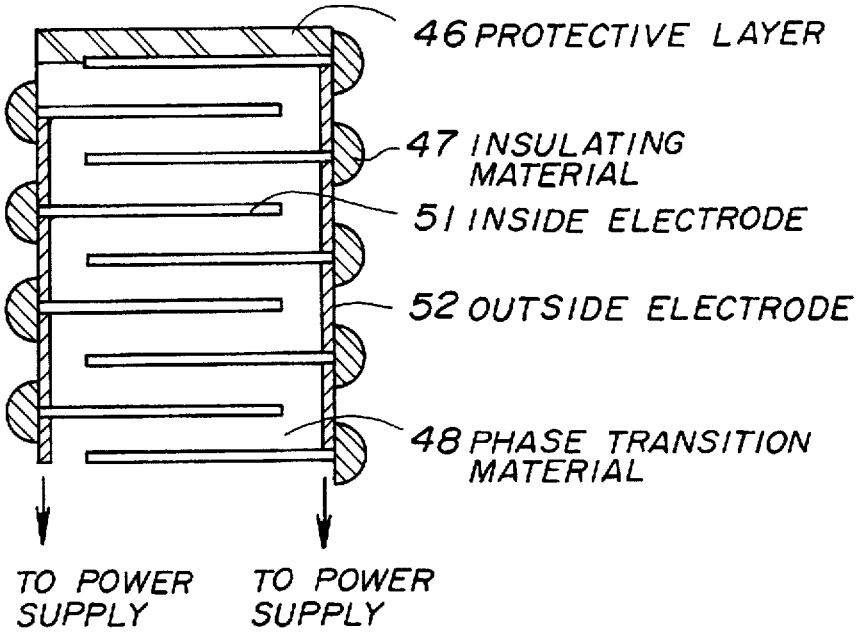
FIGS. 23A and 23B are diagrams showing two types of actuating elements used in an ink jet printing head in a sixth embodiment of the present invention.
Figure 23B:
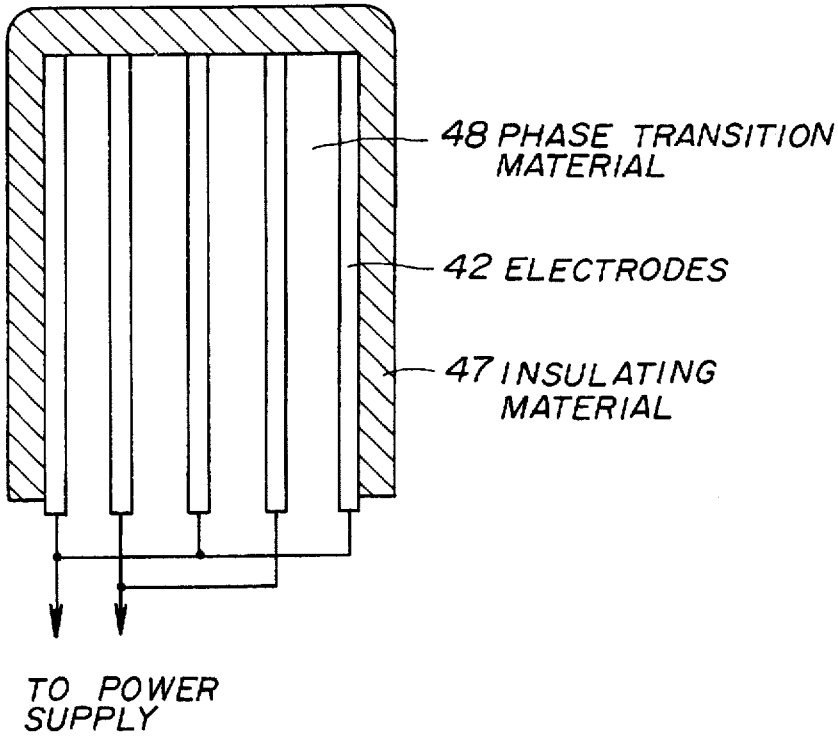

FIGS. 23A and 23B show two types of the actuating elements used in the ink jet printing head in the sixth embodiment of the present invention.

In FIG. 23A, the actuating element includes a plurality of inside electrodes 51 which are horizontally arranged at equal intervals within a phase transition material 48, and a pair of outside electrodes 52 each connected to half of the inside electrodes 51 at end portions thereof which are exposed to the outside. The end portions of the inside electrodes 51 are covered with an insulating material 47. A top portion of the actuating element is covered with a protective layer 46. The outside electrodes 52 are connected to a power supply (not shown).

In FIG. 23B, the actuating element includes a plurality of electrodes 42 which are vertically arranged at equal intervals within a phase transition material 48, and an insulating material 47 which covers the outside of the entire actuating element. The electrode 42 are connected to a power supply (not shown). Preferably, the interval between the inside electrodes 51 arranged within the phase transition material 48 or the interval between the electrodes 42 arranged within the phase transition material 48 are equal to or smaller than 100 μm.

Both the actuating elements of the two types shown in FIGS. 23A and 23B are covered with the insulating material 47, and arranged within each of ink cavities of a multi-nozzle ink jet printing head. Therefore, it is possible to suitably apply the electric field to the actuating elements of the phase transition material even when the actuating elements are arranged within the ink cavities. The insulating material makes it possible to prevent the deposition of the color of the ink within the ink cavities when the electric field is applied, and the actuating elements described above make it possible to make efficient use of the volumetric changes of the phase transition material.

The insulating material 47 is, preferably, a silicon dioxide ($SiO_2$) glass or any one of various dielectric resins including dianilphthalate resin, epoxy resin, methacrylic resin, polycarbonate resin, acrylic resin, polyamide resin, polyethylene, and polyvinyl chloride. A single-layer or multi-layer insulating material may be used in the actuating elements. A silicon dioxide layer may be produced as the insulating material 47 on the actuating element by using a known vaporization method. A dielectric resin layer may be produced as the insulating material 47 on the actuating element by using a known spin coat method.

Figure 24A:
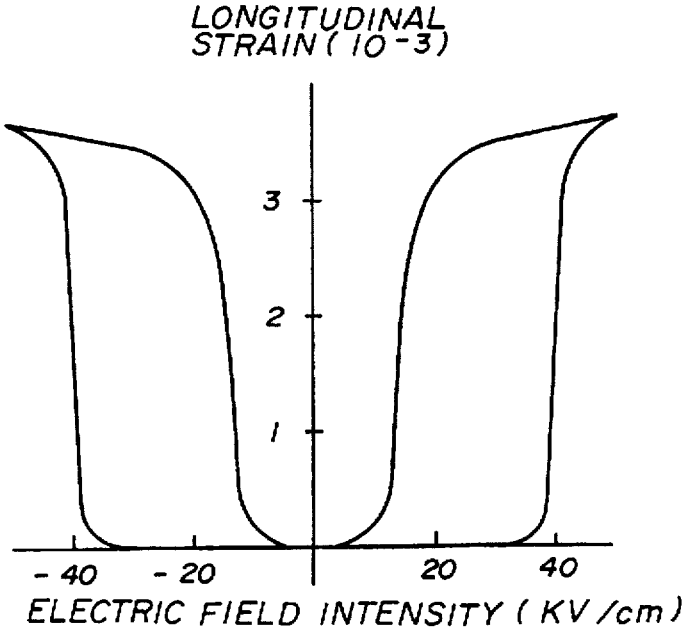
FIGS. 24A and 24B are diagrams for explaining longitudinal and transversal strains in the phase transition material of the actuator in the sixth embodiment.
Figure 24B:
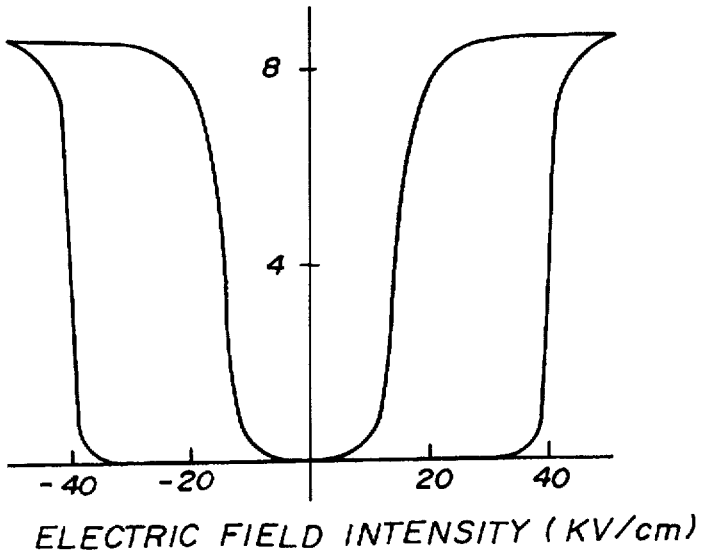

FIGS. 24A and 24B respectively show a longitudinal strain and a transversal strain of the phase transition material of the actuating elements when the electric field intensity is varied. The strain characteristics in FIGS. 24A and 24B are obtained by applying the electric field to the above sample A at temperature of 25° C. The ink within each of the ink cavities is pressed in accordance with volumetric changes of the phase transition material of the actuating elements. It is desirable that the ink cavities and the actuating elements of the ink jet printing head are heated to an increased temperature higher than room temperature by using a known heating technique. The increased temperature is, preferably, within a range of temperatures of 25° C. to 135° C. When no voltage is applied, the phase transition material (or the sample A) is in the antiferroelectric phase. When the electric field intensity is increased from zero, a transition of the phase transition material from the antiferroelectric phase into the ferroelectric phase takes place at the first transition intensity level $E_{A-F}$. The phase transition material at this time turns into the ferroelectric phase. When the electric field intensity is decreased from the highest level, a transition of the phase transition material from the ferroelectric phase into the antiferroelectric phase takes place at the second transition intensity level $E_{F-A}$. The phase transition material at this time turns back to the antiferroelectric phase.

In the case of the sample A (X=0.3, Y=0.045, Z=0.02), the first transition intensity level $E_{A-F}$ is found to be 40 kV/cm at the increased temperature mentioned above. When the phase transition material layer of the actuating element is 200 μm thick, the first transition intensity level $E_{A-F}$ has to be 800 V. When the phase transition material layer of the actuating element is 20 μm thick, the first transition intensity level $E_{A-F}$ of 80 V is realized.

As the actuating elements mentioned above are covered with the insulating material, the insulating material makes it possible to prevent the short circuit of the electrodes arranged within the phase transition material if the interval between the electrodes is reduced as small as possible. In addition, if the thickness of the phase transition material layer of the actuating element is made small, it is possible to realize a lower first transition intensity level. When the thickness of the phase transition material layer of the actuating element is reduced, the volumetric changes of the phase transition material are also reduced. However, volumetric changes of the phase transition material necessary to discharge the ink can be obtained by using an actuating element which includes a plurality of thin phase transition material layers and a plurality of electrode layers which are alternately laminated to each other.

When a hot melt type ink jet printing head is driven to discharge ink, it is necessary that the actuating elements arranged within the ink cavities are always heated by known heating elements to an increased temperature around 135° C. which is higher than normal temperature. It is necessary that the hot melt type ink jet printing head using the actuating elements described above is always heated to the increased temperature when it is driven to discharge ink, so as to prevent the strain characteristic of the phase transition material from being influenced by the temperature of the environment.

Figure 25A:
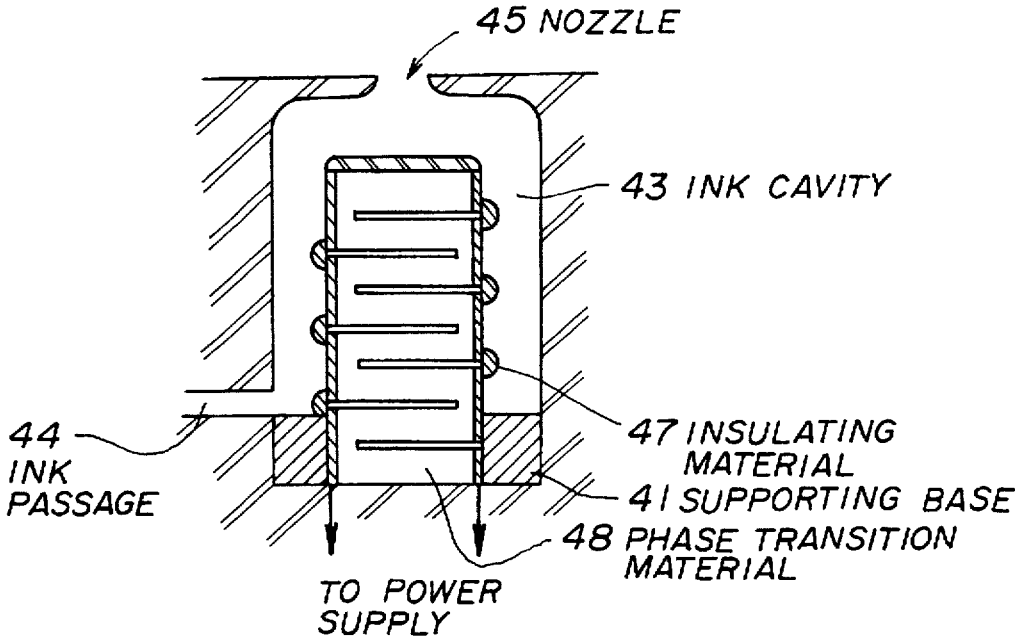
FIGS. 25A and 25B are diagrams showing two types of ink jet printing heaps which use the two actuators in FIGS. 23A and 23B respectively.
Figure 25B:
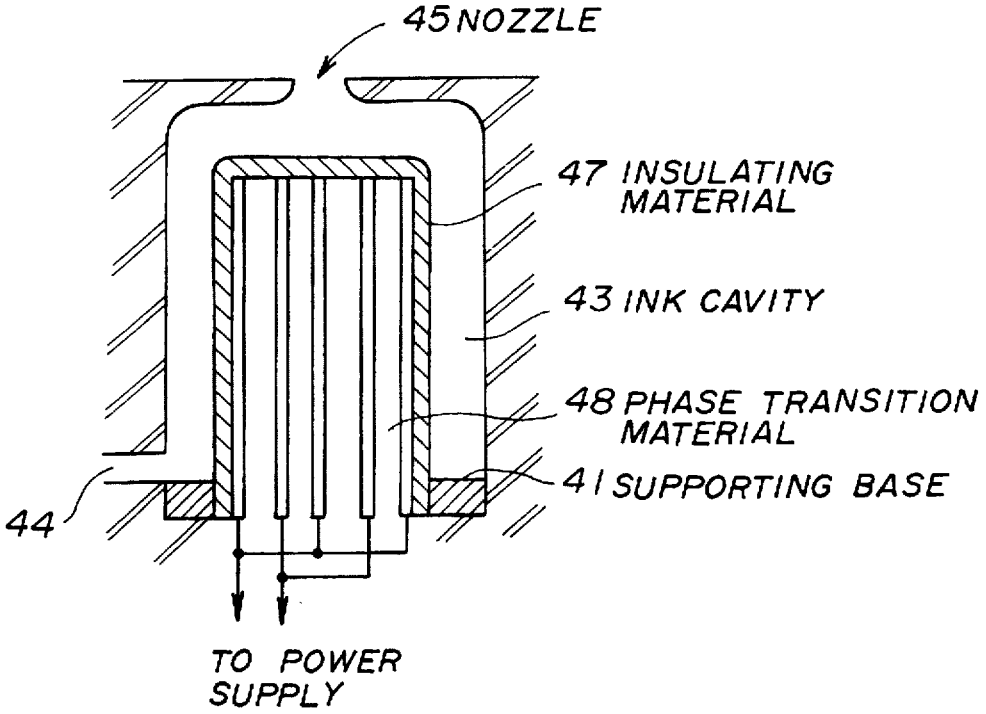

FIGS. 25A and 25B show two types of ink jet printing heads which use the actuating element in FIG. 23A and the actuating element in FIG. 23B respectively. In FIG. 25A, the actuating element which has the inside electrodes 51 horizontally arranged at equal intervals as shown in FIG. 23A is placed within each of the ink cavities of the ink jet printing head. In FIG. 25B, the actuating element which has the electrodes 42 vertically arranged at equal intervals as shown in FIG. 23B is placed within each of the ink cavities of the ink jet printing head.

Next, a description will be given of a method of driving the ink jet printing head in the sixth embodiment described above. By taking into account the above described characteristics of the ink jet printing head, a practical method of driving the ink jet printing head in the sixth embodiment is to provide the ink jet printing head with a common electrode which is connected to one of the electrode layers in each of the actuating elements so as to apply an offset voltage, to provide the ink jet printing head with a drive electrode which is connected to a different one of the electrode layers so as to apply a pulsed drive voltage, to apply the offset voltage from the common electrode to the one of the electrode layers, and to apply, at the same time as the application of the offset voltage, the pulsed drive voltage to the different one of the electrode layers. The applied offset voltage produces an electric field within the phase transition material at an intensity which is equal to or lower than the second transition intensity level $E_{F-A}$. The pulsed drive voltage corresponds to a print data signal used by the ink jet printing head to print an image on a sheet of paper.

Figure 26A:
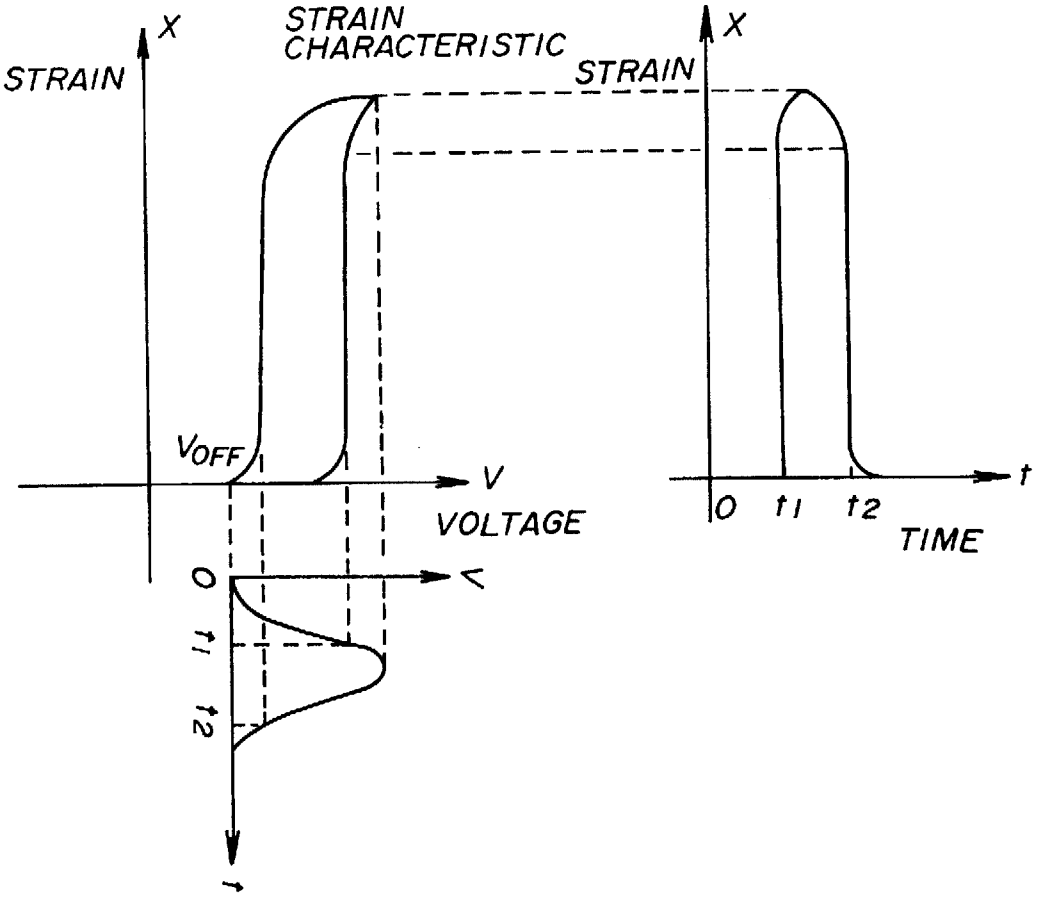
FIGS. 26A and 26B are diagrams respectively showing a strain characteristic of the phase transition material when an offset voltage is applied to a common electrode and a strain characteristic of the phase transition material when no offset voltage is applied.
Figure 26B:
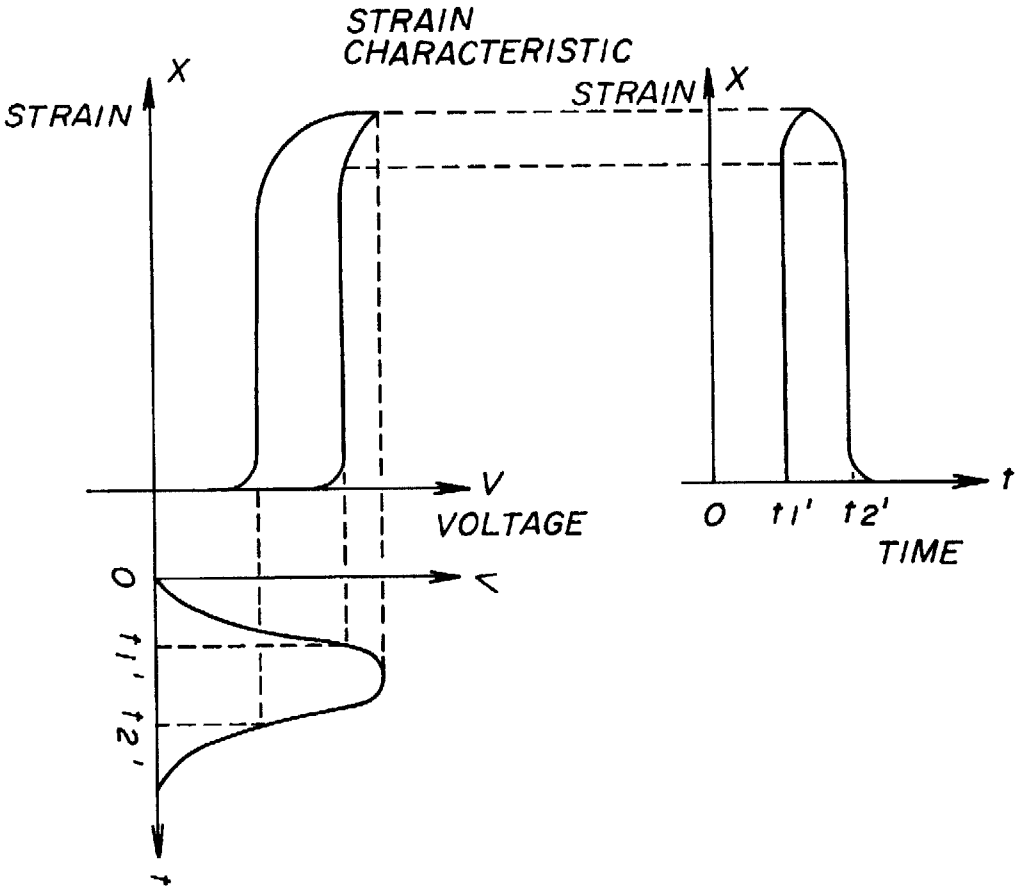
Figure 27:
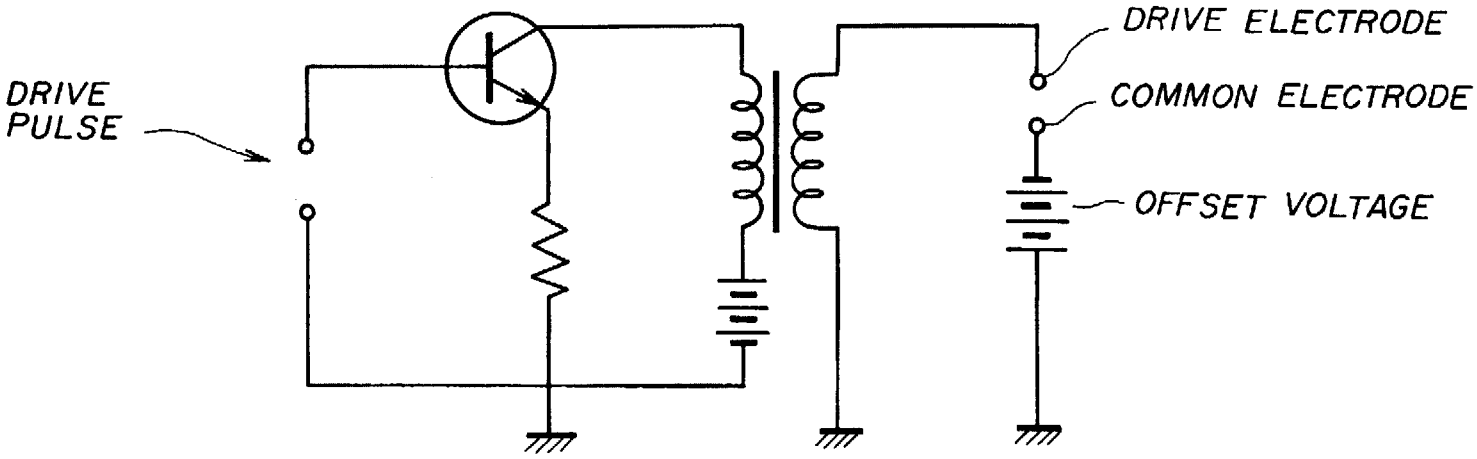
FIG. 27 is a circuit diagram showing a drive circuit for driving the ink jet printing head in the sixth embodiment.

FIGS. 26A and 26B respectively show a strain characteristic of the phase transition material when the offset voltage is applied from the common electrode, and a strain characteristic of the phase transition material when no offset voltage is applied. FIG. 27 shows a drive circuit for driving the ink jet printing head in the sixth embodiment. The drive circuit in FIG. 27 includes the common electrode and the drive electrode described above. As the offset voltage producing an electric field intensity below the second transition intensity level $E_{F-A}$ is applied to the electrode layers of the actuating elements, the pulsed drive voltage applied to the electrode layers can be reduced to a level lower than the pulsed drive voltage when no offset voltage is applied. The ink discharging efficiency when the offset voltage is applied is substantially the same as the ink discharging efficiency when no offset voltage is applied.

Two printing methods using the ink jet printing head in the sixth embodiment are available for an ink jet printer. One printing method is to discharge ink by increasing the volume of the phase transition material before the ink discharge, and the other is to discharge ink by decreasing the volume of the phase transition material before the ink discharge and then increasing the volume of the phase transition material. In order to realize these printing methods with the ink jet printing head used, it is necessary that the offset voltage producing an electric field intensity below the second transition intensity level $E_{F-A}$ is applied and the pulse drive voltage corresponding to the print data signal is applied at the same time.

Next, a description will be given of some test results of examples of the ink jet printing head in the sixth embodiment of the present invention.

[EXAMPLE 4]

The composition of a test sample of the phase transition material used by this example of the ink jet printing head in the sixth embodiment is defined by: $Pb_{0.997}La_{0.02}[(Zr_{0.725}Sn_{0.275})_{0.91}Ti_{0.09}]O_3$. A platinum electrode is formed on a sheet of the above sample of the phase transition material having an about 20-μm thickness by a thick-film printing method. A laminate medium which is composed of eight 20-μm thick phase transition material layers and eight electrode layers which are alternately laminated to each other is produced by repeating the printing procedure. This laminate medium is cut into pieces having an about 60 μm width, and a film of silicon dioxide glass of the insulating material having an about 10 μm thickness is formed at end portions of the electrode layers of one of the pieces, so that the actuating element having a multilayer structure shown in FIG. 23A is produced. By arranging the thus produced actuating elements within each of the ink cavities as shown in FIG. 25A, the example of the ink jet printing head is produced.

A common electrode is connected to one of the electrode layers in each of the actuating elements to apply an offset voltage, and a drive electrode is connected to a different one of the electrode layers in each of the actuating elements to apply a pulsed drive voltage. A drive circuit having the common electrode and the drive electrode is as shown in FIG. 27. When the example of the ink jet printing head is driven by using this drive circuit, the offset voltage is applied from the common electrode to the one of the electrode layers of each of the actuating elements, and, at the same time, the pulsed drive voltage is applied from the drive electrode to the different one of the electrode layers. The applied offset voltage produces an electric field within the phase transition material at an intensity which is equal to or lower than the second transition intensity $E_{F-A}$. The pulsed drive voltage corresponds to a print data signal used by the ink jet printing head to print an image on a sheet of paper. It is found that ink drops are suitably discharged by the example of the ink jet printing head.

[EXAMPLE 5]

The composition of a test sample of the phase transition material used by this example of the ink jet printing head is the same as the test sample in the above Example 4. A laminate medium which is composed of three 20-μm thick phase transition material layers and three electrode layers which are alternately laminated to each other is produced. This laminate medium is cut into pieces having an about 160 μm width, and a film of polycarbonate resin of the insulating material is formed on the entire actuating element. Thereafter, the example of the ink jet printing head as shown in FIG. 25B is produced. Similarly to the Example 4, the example of the ink jet printing head is driven by using the drive circuit, and it is found that ink drops are suitably discharged by the example of the ink jet printing head.

[EXAMPLE 6]

The composition of a test sample of the phase transition material used by this example of the hot melt type ink jet printing head is defined by:

$$Pb_{0.985}Nb_{0.3}[(Zr_{0.998}Sn_{0.02})_{0.955}Ti_{0.045}]_{0.7}O_3.$$

A strain characteristic of this sample of the phase transition material when the electric field intensity is varied is examined. As a result, the first transition intensity level $E_{A-F}$ is 40 kV/cm at 135° C. and the second transition intensity level $E_{F-A}$ is 26 kV/cm at 135° C. It is found in each of the phase transitions that the longitudinal strain is 0.34%, the transversal strain is 0.085%, and the rate ▲V/V of change of the volume is 0.51. Similarly to the Example 4, the example of the ink jet printing head is produced. The actuating elements are heated to maintain a temperature of 135° C., and a solid ink containing natural wax and having a boiling point of 100° C. is used, and the example of the ink jet printing head is driven by using the drive circuit in order to check the printing. It is found that ink drops are suitably discharged by the example of the hot melt type ink jet printing head.

[EXAMPLE 7]

The composition of a test sample of the phase transition material used by this example of the ink jet printing head is defined by:

$$Pb_{0.92}La_{0.08}(Zr_{0.7}Ti_{0.3})_{0.98}O_3.$$

A strain characteristic of this sample of the phase transition material when the electric field intensity is varied is examined. As a result, the first transition intensity level $E_{A-F}$ is 35 kV/cm at 30° C. and the second transition intensity level $E_{F-A}$ is 18 kV/cm at 30° C. It is found in each of the phase transitions that the longitudinal strain is 0.21%, the transversal strain is 0.07%, and the rate ▲V/V of change of the volume is 0.35. Similarly to the Example 5, the example of the ink jet printing head is produced. The example of the ink jet printing head is driven by using the drive circuit, and it is found that ink drops are suitably discharged by the example of the ink jet printing head.

As described above in the foregoing, it is possible to realize an ink jet printing head having a remarkably high ink discharging efficiency in conformity with the needs of recent ink jet printers by making use of the phase transition material according to the present invention. In addition, it is possible to realize a multi-nozzle ink jet printing head having a small size in conformity with the needs of recent ink jet printers by making use of the phase transition material according to the present invention. Further, it is possible to realize a remarkably high ink discharging rate of an ink jet printing head with a smaller size by using the actuating elements of the phase transition material which are arranged within each of the ink cavities.

Further, the present invention is not limited to the above described embodiments, and various variations and modifications may be made without departing from the scope of the present invention.

What is claimed is:

1. An ink jet printing head comprising:

a nozzle plate including a plurality of nozzles;

an oscillating plate spaced from said nozzle plate;

a plurality of ink cavities positioned between said nozzle plate and said oscillating plate such that one of said ink cavities corresponds to one of said nozzles, and wherein each of said ink cavities contains ink and said oscillating plate has a top surface with which the ink in each of said ink cavities is brought into contact;

a plurality of actuators bonded to a bottom surface of said oscillating plate such that a corresponding one of said actuators is aligned with one of said cavities, wherein each of said actuators is made of a phase transition material capable of transition between an antiferroelectric phase and a ferroelectric phase that includes a solid solution of composite ceramics which upon actuation causes said oscillating plate to deflect so as to press the ink within each of said ink cavities in association with said actuators to discharge ink drops from said nozzles; and electric field applicator to apply an electric field to each of the plurality of actuators, wherein said oscillating plate deflects in accordance with volumetric charges of each of said actuators, said volumetric changes being developed by applying the electric field to each of said actuators at a given electric field intensity, wherein an increase of said given electric field intensity causing a transition of said phase transition material from an antiferroelectric phase into a ferroelectric phase and wherein a decrease of said given electric field intensity causing a transition of said phase transition material from the ferroelectric phase into the antiferroelectric phase, wherein said solid solution of composite ceramics includes lead zirconate, lead stannate and lead titanates, and lanthanum partially substituting for a lead site thereof, and wherein a composition of said phase transition material is defined by:

$$Pb_{1-3/22}La_Z((Zr_{1-X}Sn_X)_{1-Y}Ti_Y)O_3$$

where $0 \leqq X \leqq 0.5$, $0 \leqq Y \leqq 0.2$, $0 \leqq Z \leqq 0.02$ and where X, Y and Z are rational numbers.

2. An ink jet printed head according to claim 1, wherein each of said actuators comprises a plurality of thin layers of said phase transition material and a plurality of electrode layers laminated together such that said plurality of layers of said phase transition material and said electrode layers are alternately arranged.

3. An ink jet printing head according to claim 1, wherein each of said actuators comprises a plurality of thin layers of said phase transition material, said thin layers being arranged within each of said actuators parallel to said oscillating plate.

4. An ink jet printing head according to claim 1, wherein each of said actuators comprises a plurality of thin layers of said phase transition material, said thin layers being arranged within each of said actuators perpendicular to said oscillating plate.

5. An ink jet printing head according to claim 1, wherein each of said actuators comprises two or more thin layers of said phase transition material, said two or more thin layers extending in parallel to said oscillating plate and being laminated to each other within each of said actuators in a direction perpendicular to said oscillating plate.

6. An ink jet printing head according to claim 1, further comprising a plurality of heating elements arranged adjacent to each of said actuators, wherein said actuators are heated by said heating elements to an increased temperature.

7. An ink jet printing head according to claim 1, wherein said oscillating plate comprises a first portion having a top surface, and second portions which are bonded to said actuators such that one of said second portions corresponds to one of said actuators, said second portions having a thickness larger than a thickness of said first portion.

8. An ink jet printing head comprising:

a base;

a nozzle plate spaced from said base and including a plurality of nozzles;

an oscillating plane positioned between said nozzle plate and said base;

a plurality of ink cavities positioned between said nozzle plate and said oscillating plate such that one of said ink cavities corresponds to one of said nozzles, and where each of said ink cavities contains ink, and said oscillating plate has a top surface with which the ink in each of said ink cavities is brought into contact;

a plurality of pressure fluid chambers positioned between said oscillating plate and said base such that pressure fluid within each of said chambers is brought into contact with a bottom surface of said oscillating plate;

a plurality of actuators arranged in said plurality of pressure fluid chambers such that one of said actuators corresponds to one of said pressure fluid chambers and wherein each of said actuators is made of a phase transition material capable of transition between an antiferroelectric phase and a ferroelectric phase that includes a solid solution of composite ceramics such that when actuated said oscillating plate deflects so as to press the ink within each of said ink cavities in association with said actuators to discharge ink drops from said nozzles; and electric field applicator to apply an electric filed to each of said actuators, wherein the ink in each of said ink cavities is pressed by said oscillating plate in accordance with volumetric changes of each of said actuators, said volumetric changes being developed by applying the electric field to each of said actuators at a given electric field intensity, wherein an increase of said given electric field intensity causing a transition of said phase transition material from an antiferroelectric phase into a ferroelectric phase and wherein a decrease of said given electric field intensity causing a transition of said phase transition material from the ferroelectric phase into the antiferroelectric phase, and said volumetric changes of each of said actuators being transferred to said oscillating plate through the pressure fluid in each od said pressure fluid chambers, wherein said solid solution of composite ceramics includes lead zirconate, lead stannate and lead titanate, and lanthanum partially substituting for a lead site thereof, and wherein a composition of said phase transition material is defined by:

$$Pb_{1-3/22}La_Z((Zr_{1-X}Sn_X)_{1-Y}Ti_Y)O_3$$

where $0 \leqq X \leqq 0.5$, $0 \leqq Y \leqq 0.2$, $0 \leqq Z \leqq 0.02$ and where X, Y and Z are rational numbers.

9. An ink jet printing head according to claim 8, wherein each of said actuators comprises a plurality of thin layers of said phase transition material and a plurality of electrode layers laminated together such that said plurality of layers of said phase transition material and said electrode layers are alternately arranged.

10. An ink jet printing head according to claim 8, wherein said pressure fluid in each of said pressure fluid chambers is an insulating liquid having an electric resistivity equal to or greater than $10^5$ ohm.meters.

11. An ink jet printing head according to claim 8, wherein said pressure fluid in each of said pressure fluid chambers is a liquid capable of flowing at temperatures of −20° C. to 150° C. and boils at a temperature equal to or higher than 100° C.

12. An ink jet printing head according to claim 8, further comprising a common fluid chamber which communicates with each of said pressure fluid chambers and has an opening that permits an inside of said common fluid chamber to open to the atmosphere.

13. An ink jet printing head according to claim 8, further comprising a heating element which is arranged adjacent to each of the ink cavities and to each of the pressure chambers, wherein the ink within each of the ink cavities is a liquid-state ink produced by heating a solid-state ink by using said heating element.

14. An ink jet printing head comprising:

a nozzle plate including a plurality of nozzles;

a plurality of ink cavities aligned with said nozzle plate such that one of said ink cavities corresponds to one of said nozzles, and each of said ink cavities contains ink;

a plurality of actuating elements respectively provided within each of said ink cavities, each of said actuating elements being made of a phase transition material capable of transition between an antiferroelectric phase and a ferroelectric phase that comprises a solid solution of composite ceramics, and comprising electrode layers and an insulating material for insulating at least said electrode layers from the ink in each of said ink cavities; and electric field applicator to apply an electric field to each said actuating element, wherein ink in each of said ink cavities is discharged from said nozzles upon actuation of said actuating elements in accordance with volumetric changes of the phase transition material, said volumetric changes being developed by applying the electric field to each of said actuating elements at a given electric field intensity, wherein an increase of said given electric field intensity causing a transition of said phase transition material from an antiferroelectric phase into a ferroelectric phase and wherein a decrease of said given electric field intensity causing a transition of said phase transition material from the ferroelectric phase into the antiferroelectric phase, wherein said solid solution of composite ceramics includes lead zirconate, lead stannate and lead titanate, and lanthanum partially substituting for a lead site thereof, and wherein a composition of said phase transition material is defined by:

$$Pb_{1-3/22}La_Z((Zr_{1-X}Sn_X)_{1-Y}Ti_Y)O_3$$

where $0 \leqq X \leqq 0.5$, $0 \leqq Y \leqq 0.2$, $0 \leqq Z \leqq 0.02$ and where X, Y and Z are rational numbers.

15. An ink jet printing head according to claim 14, wherein each of said actuating elements comprises a plurality of thin layers of the phase transition material and a plurality of the electrode layers which are alternately laminated to each other.

16. An ink jet printing head according to claim 14, wherein said electrode layers in each of said actuating elements are spatially arranged within the phase transition material at equal intervals, wherein said interval between said electrode layers is equal to or smaller than 100 μm.

17. An ink jet printing head according to claim 14, wherein said electrode layers in each of said actuating elements are vertically arranged at equal intervals within the phase transition material.

18. An ink jet printing head according to claim 14, wherein said electrode layers in each of said actuating elements are horizontally arranged at equal intervals within the phase transition material.

19. An ink jet printing head according to claim 14, further comprising a plurality of heating elements arranged adjacent to each of said actuating elements, wherein said actuating elements are heated by said heating elements to an increased temperature.

20. A method for driving an ink jet printing head, comprising steps of:

providing an ink jet printing head comprising:

a nozzle plate including a plurality of nozzles, a plurality of ink cavities aligned with said nozzle plate such that one of said ink cavities corresponds to one of said nozzles, and each of said ink cavities contains ink, a plurality of actuating elements respectively provided within each of said ink cavities, each of said actuating elements being made of a phase transition material capable of transition between an antiferroelectric phase and a ferroelectric phase that comprises a solid solution of composite ceramics, and comprising electrode layers and an insulating material for insulating at least said electrode layers from the ink in each of said ink cavities, and electric field applicator to apply an electric field to each said actuating element, wherein ink in each of said ink cavities is discharged from said nozzles upon actuation of said actuating elements in accordance with volumetric changes of the phase transition material, said volumetric changes being developed by applying the electric field to each of said actuating elements at a given electric field intensity, wherein an increase of said given electric field intensity causing a transition of said phase transition material from an antiferroelectric phase into a ferroelectric phase and wherein a decrease of said given electric field intensity causing a transition of said phase transition material from the ferroelectric phase into the antiferroelectric phase, wherein said solid solution of composite ceramics includes lead zirconate, lead stannate and lead titanate, and lanthanum partially substituting for a lead site thereof, and wherein s composition of said phase transition material is defined by:

$$Pb_{1-3/22}La_Z((Zr_{1-X}Sn_X)_{1-Y})O_3$$

where $0 \leqq X \leqq 0.5$, $0 \leqq Y \leqq 0.2$, $0 \leqq Z \leqq 0.02$ and where X, Y and Z are rational numbers;

providing said ink jet printing head with a common electrode which is connected to one of said electrode layers in each of said actuating elements to apply an offset voltage from said common electrode;

providing said ink jet printing head with a drive electrode which is contacted to a different one of said electrode layers in each of said actuating elements to apply a pulsed drive voltage from said drive electrode;

applying the offset voltage to said one of said electrode layers, said applied offset voltage producing an electric field within the phase transition material at an intensity which is equal to or lower than said given electric field intensity; and applying, at the same time as said application of the offset voltage, the pulsed drive voltage to said different one of said electrode layers, said pulsed drive voltage corresponding to a print data signal used by the ink jet printing head to print an image on a sheet of paper.

* * * * *